US011313186B2

(12) United States Patent
Rolovic et al.

(10) Patent No.: US 11,313,186 B2
(45) Date of Patent: Apr. 26, 2022

(54) WORKFLOW METHOD FOR CONNECTING COILED TUBING STRINGS FOR EXTENDED REACH APPLICATIONS

(71) Applicant: Halliburton Energy Services, Inc., Houston, TX (US)

(72) Inventors: Radovan Rolovic, Sugar Land, TX (US); Shubhangi Dalavi, Spring, TX (US); Eric Bivens, Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/172,297

(22) Filed: Feb. 10, 2021

(65) Prior Publication Data

US 2021/0246742 A1 Aug. 12, 2021

Related U.S. Application Data

(60) Provisional application No. 62/975,520, filed on Feb. 12, 2020.

(51) Int. Cl.

| | |
|---|---|
| ***E21B 17/02*** | (2006.01) |
| ***E21B 17/04*** | (2006.01) |
| ***E21B 17/20*** | (2006.01) |
| ***E21B 19/22*** | (2006.01) |

(52) U.S. Cl.
CPC ..... *E21B 19/22* (2013.01); *E21B 17/041* (2020.05); *E21B 17/20* (2013.01)

(58) Field of Classification Search
CPC ..... E21B 17/02; E21B 17/04; E21B 17/041; E21B 17/20; E21B 19/22
See application file for complete search history.

(56) References Cited

U.S. PATENT DOCUMENTS

| | | | | |
|---|---|---|---|---|
| 6,264,244 | B1 * | 7/2001 | Isennock | E21B 17/02 285/55 |
| 7,237,809 | B2 * | 7/2007 | Connell | E21B 17/04 285/256 |
| 7,677,302 | B2 * | 3/2010 | Ehtesham | E21B 17/20 166/77.2 |
| 2007/0068678 | A1 | 3/2007 | McKee et al. | |
| 2008/0066961 | A1 | 3/2008 | Aivalis et al. | |
| 2008/0073085 | A1 * | 3/2008 | Lovell | E21B 17/04 166/377 |
| 2018/0112473 | A1 * | 4/2018 | Howell, Sr. | F16L 27/04 |

FOREIGN PATENT DOCUMENTS

| | | |
|---|---|---|
| EP | 1944463 A1 | 7/2008 |

* cited by examiner

*Primary Examiner* — Matthew R Buck
(74) *Attorney, Agent, or Firm* — Thomas Rooney; Parker Justiss, P.C.

(57) ABSTRACT

Provided is a method for connecting coiled tubing strings, and a coiled tubing working connector, in accordance with one aspect of the disclosure. The method for connecting coiled tubing strings, in one aspect, includes lowering a downhole end of a first coiled tubing string within a wellbore, an uphole end of the first coiled tubing string remaining outside of the wellbore. The method, in one aspect, further includes coupling the uphole end of the first coiled tubing string to a downhole end of a second coiled tubing string while the uphole end of the first coiled tubing string remaining outside of the wellbore to form a combined coiled tubing string, and lowering the combined coiled tubing string within the wellbore.

17 Claims, 22 Drawing Sheets

WORKFLOW METHOD FOR CONNECTING COILED TUBING STRINGS FOR EXTENDED REACH APPLICATIONS

CROSS-REFERENCE TO RELATED APPLICATION

This application claims the benefit of U.S. Provisional Application Ser. No. 62/975,520, filed on Feb. 12, 2020, entitled "WORKFLOW METHOD FOR CONNECTING CT STRINGS FOR EXTENDED REACH APPLICATIONS USING ARTICULATED ARM FOR SECURING COILED TUBING," commonly assigned with this application and incorporated herein by reference in its entirety.

BACKGROUND

Coiled or spoolable tubing is commonly used in various oil and gas operations, which include drilling of wellbores, work over operations, completion operations and production operations, among others. A coiled tubing is a continuous tubing that is spooled on a reel as a conveying device for one or more downhole tools. An injector is typically used to run the coiled tubing into and out of the wellbore. For drilling, a bottom hole assembly carrying a drill bit at its bottom (downhole) end may be attached to the coiled tubing's bottom end. The coiled tubing is hollow or has a through passage, which acts as a conduit for the drilling and process fluid to be supplied downhole under pressure from the surface. For completion and workover operations, the coiled tubing may be used to convey one or m ore devices into and/or out of the wellbore.

BRIEF DESCRIPTION

Reference is now made to the following descriptions taken in conjunction with the accompanying drawings, in which.

Figure 15:
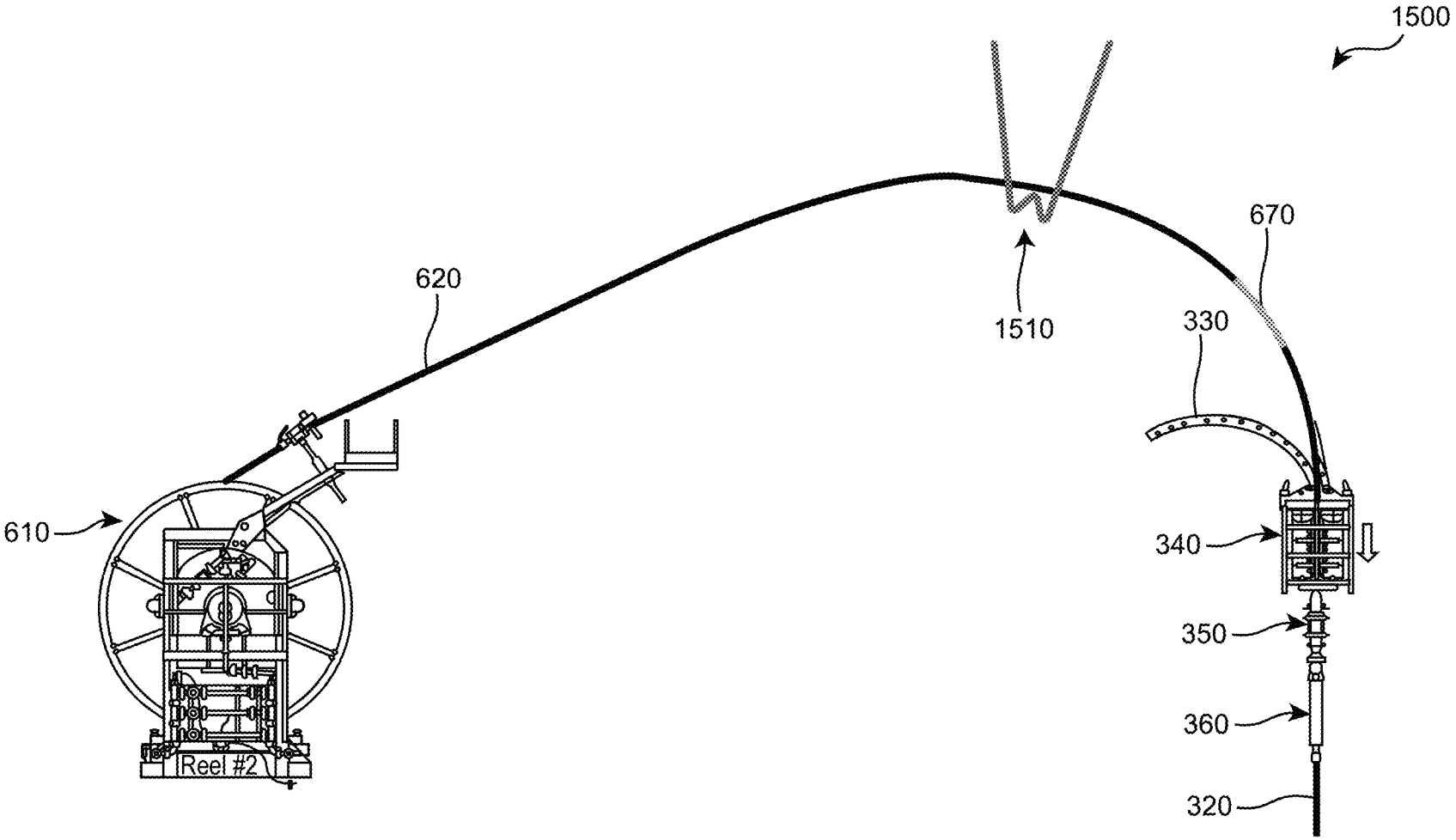
Figure 16:
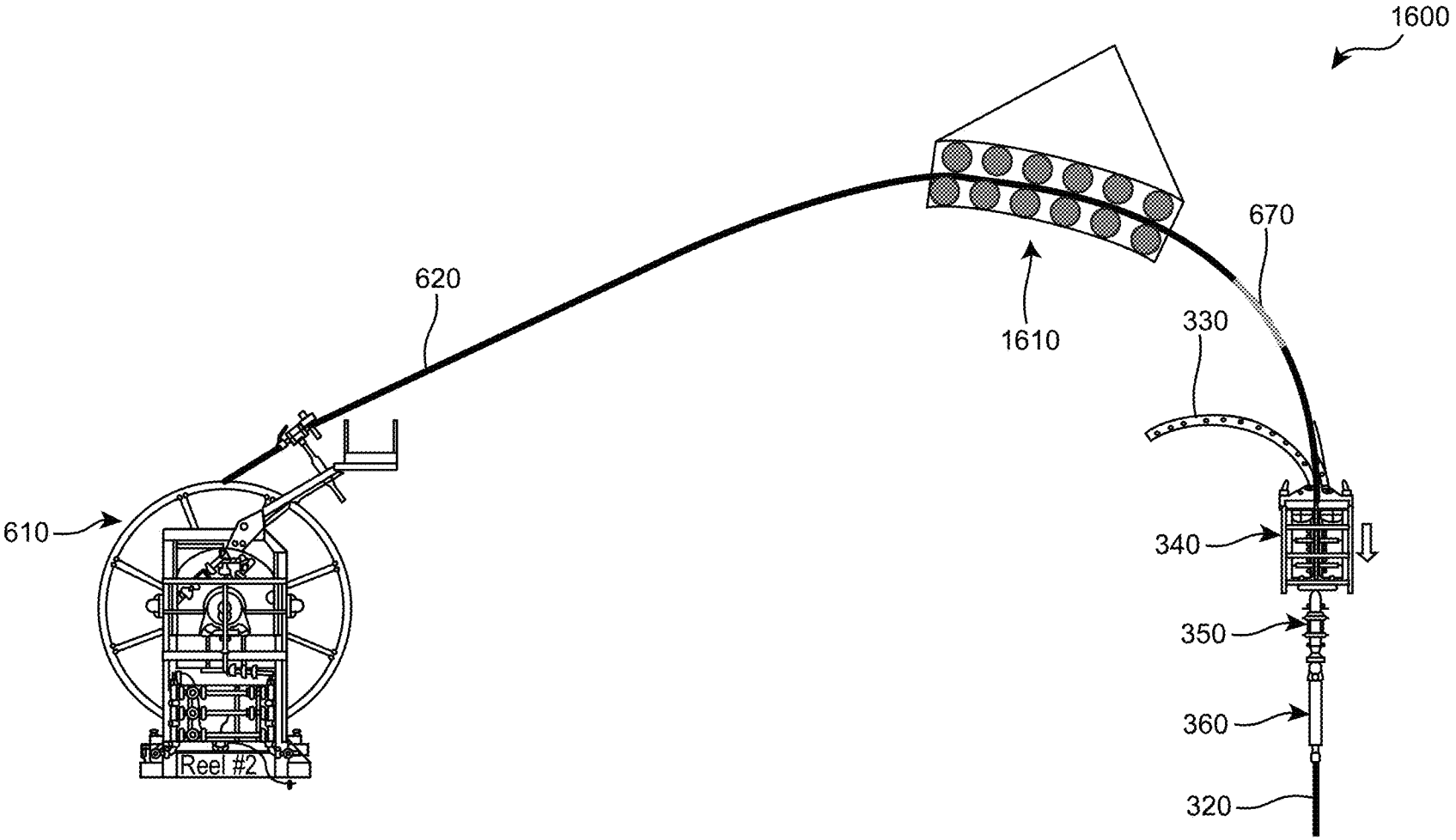

FIG. 15 illustrates a modified workflow method for guiding the working connector coupling the first and second coiled tubing strings together into the coiled tubing guide arch, for example using a crane and roller clamp; and FIG. 16 illustrates a modified workflow method for feeding the rigid connector past the guide arch, by incorporating a "flying gooseneck" similar to those used in catenary or vessel to deck spooling operations.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles, aspects or embodiments of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The global trend sees wells increasing in length, especially lateral length (e.g., upwards of about 12,200 meters measured depths). Accordingly, some operators are drilling wells they know cannot be accessed by conventional light intervention methods. Current light intervention methods are limited to the maximum reach capability of coiled tubing, based on the maximum length of tubing that can be combined on a single spool. The spool capacity is often capped by the maximum transport load of a trailer, the maximum lift capacity of a crane, rigging space limitations, and/or simply the size of the available reels.

Some methods use combined jointed pipe and coiled tubing to extend the workable reach of a coiled tubing string, which may involve two separate pipe handling and drive mechanisms, thereby increasing the amount of surface equipment and job skills required on surface. Aspects of the present disclosure include a safe, reliable, fast connecting system that can join two coiled tubing strings from two different reels together. In certain embodiments, the two coiled tubing strings are joined together between the injector and the wellhead stack. For example, in at least one embodiment, the two coiled tubing strings are joined together in a work/access window positioned downhole of the injector, with a stabbing/deployment/retrieval device (hereinafter, "stabbing snake") to aid with alternating between coiled tubing reels/strings. In yet another embodiment, the two coiled tubing strings are joined together uphole of the coiled tubing injector, for example between the coiled tubing injector and the coiled tubing reels containing the two coiled tubing strings. A system according to this disclosure may, in one aspect, be used to connect sections of coiled tubing having the same outer diameter (OD) and inner diameter (ID), as well as sections having different ODs and/or IDs.

A proposed method, for example, may deploy multiple coiled tubing strings, of the same or differing OD and wall thickness, into a wellbore by combining them in sequence/series into a combined coiled tubing string, thus extending the reach of the combined coiled tubing string beyond the limit of an individual coiled tubing string, and thus exceed the limitations of the capacity of a single spool of coiled tubing. This workflow may employ a single injector set-up with a pressure containing or non-pressure containing work window for making and breaking the connections between multiple coiled tubing strings. The different coiled tubing reels can have a spoolable/pre-installed (e.g., dimple-on, roll-on, high pressure flexible hose or temporary connector fastened to the coiled tubing in any manner) connector at or near the end of the base wrap and/or at/near the whip end of their respective cool tubing strings, which are either connected or removed prior to connecting the coiled tubing strings in the work window that may be secured on the blowout preventer/wellhead stack, after securing the coiled tubing and containing well pressure. A stabbing snake may be used in certain embodiments to facilitate deployment/retrieval of either of the coiled tubing strings through the injector and into the well. Telescopic/articulated tubing handling equipment may also be used to manage tubing movement prior to landing both strings in the work window.

This method may be used to expand the range of service capability for coiled tubing applications on offshore or onshore platforms with limited rigging space or limited crane capacity. For example, the method may enable the use of multiple (e.g., two, three, four or more) smaller coiled tubing strings rather than a single large string. As a benefit over methods utilizing jointed pipe and coiled tubing, the same equipment may be used to deploy all sections of the coiled tubing strings, as opposed to needing separate sets of pipe handling equipment. The operator qualifications are consistent throughout the operation, and no procedural variances or other operating considerations are needed between the different sections of the coiled tubing strings, thus improving the overall safety and efficiency of the operation. Moreover, this method will allow current generation surface equipment to remain viable for servicing super extended reach wells, and provide additional work scope capabilities for coiled tubing strings in work environments with limited deck space and/or crane lift capacities. This disclosure specifies a unique method to address this problem by employing only coiled tubing (e.g., no jointed pipe) in one embodiment to access these hard to reach areas, all the while expediting the drilling process.

Figure 1:
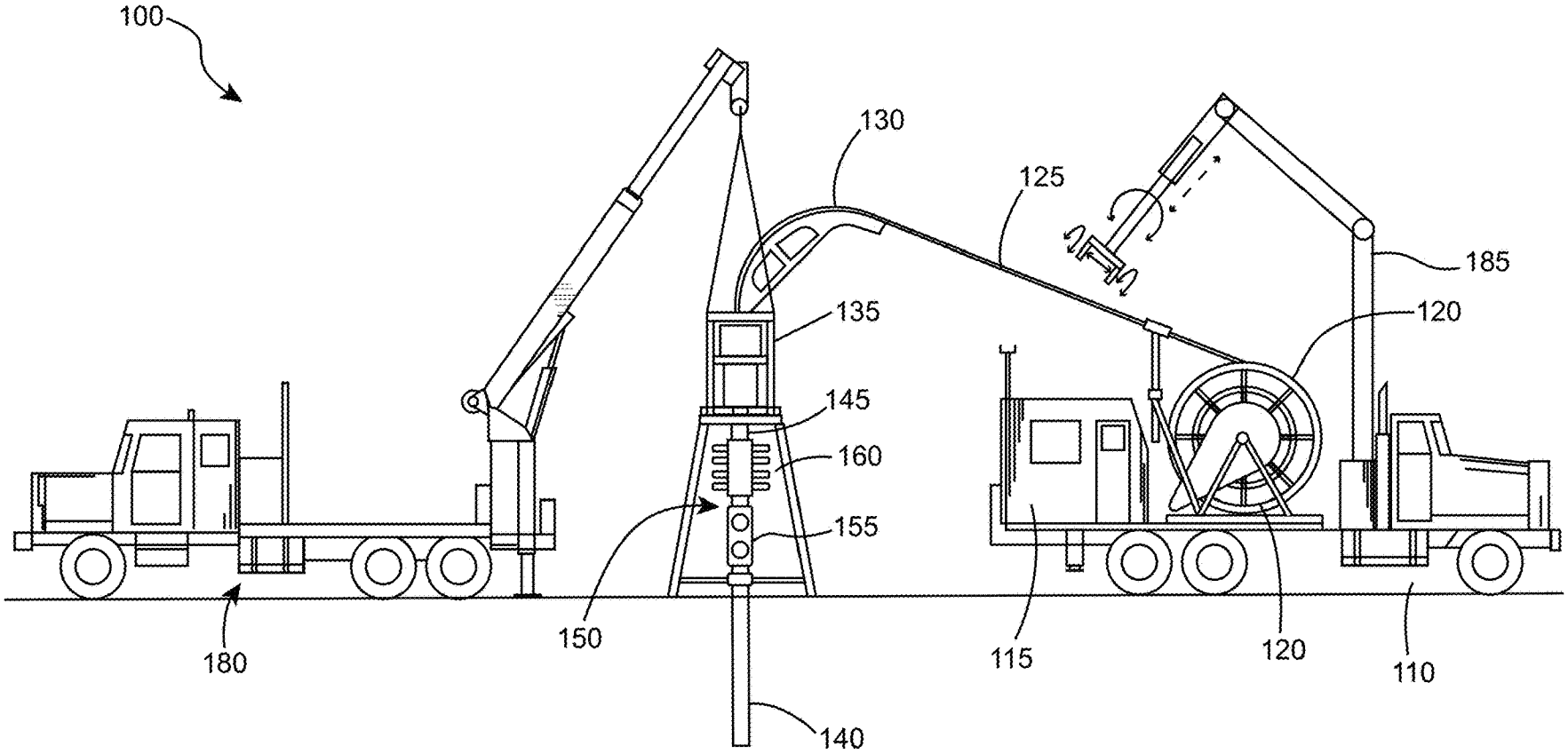
FIG. 1 illustrates a coiled tubing surface equipment spread for running coiled tubing, the coiled tubing surface equipment spread designed, manufactured and operated according to the disclosure.

FIG. 1 illustrates a coiled tubing surface equipment spread 100 for running coiled tubing, the coiled tubing surface equipment spread designed, manufactured and operated according to the disclosure. In at least one embodiment, the coiled tubing surface equipment spread includes a truck 110, a wellhead stack 150, and a crane truck 180. In the illustrated embodiment, the truck 110 (e.g., coiled tubing truck) carries behind its cab a power pack including a hook-up to the truck motor or power take off, hydraulic pumps and an air compressor. The coiled tubing injecting operation can be run from the control cab 115 located at the rear of truck 110. Control cab 115 may comprise the operational center. Reel 120 comprises the spool that carries the coiled tubing string to/at the job site. Reel 120 is often limited in its outside spool diameter so that, with a full load of coiled tubing wound thereon, the reel can be trucked over the highways or waterway and to a job site.

FIG. 1 additionally illustrates coiled tubing string 125 passed over a coiled tubing guide arch 130 (e.g., gooseneck guide) and inserted into a wellbore 140 using a coiled tubing injector 135. Coiled tubing injector 135 often involves two hydraulic motors and two counter-rotating chains by means of which the coiled tubing injector 135 grips the coiled tubing string 125 and spools or unspools the coiled tubing string 125 to and from the reel 120. Coiled tubing stripper 145 provides a pressure barrier between coiled tubing string 125 and the wellbore 140. The wellhead stack 150 is illustrated as having a typical well Christmas tree 155 and blowout preventer 160. The crane truck 180 provides lifting means for working at the well site.

FIG. 1 further illustrates telescopic/articulated pipe handling equipment 185 designed, manufactured and operated according to the disclosure. The telescopic/articulated pipe handling equipment 185 is illustrated as being coupled to the truck 110, but it could easily be attached to the crane truck 180 or be deployed as its own standalone device (e.g., truck, tractor, etc.). The telescopic/articulated pipe handling equipment 185 may have free range of motion so as to grip, position, and re-position coiled tubing string wherever it may need to be placed within a large radius around the coiled tubing equipment surface spread 100. The telescopic/articulated pipe handling equipment 185 may include one or more separate articulating arms. Note that in some examples the telescopic/articulated pipe handling equipment 185 may be replaced by an additional crane unit to secure/position the coiled tubing string, or even with a series of tubing clamps and guide lines handled by ground personnel.

Figure 2:
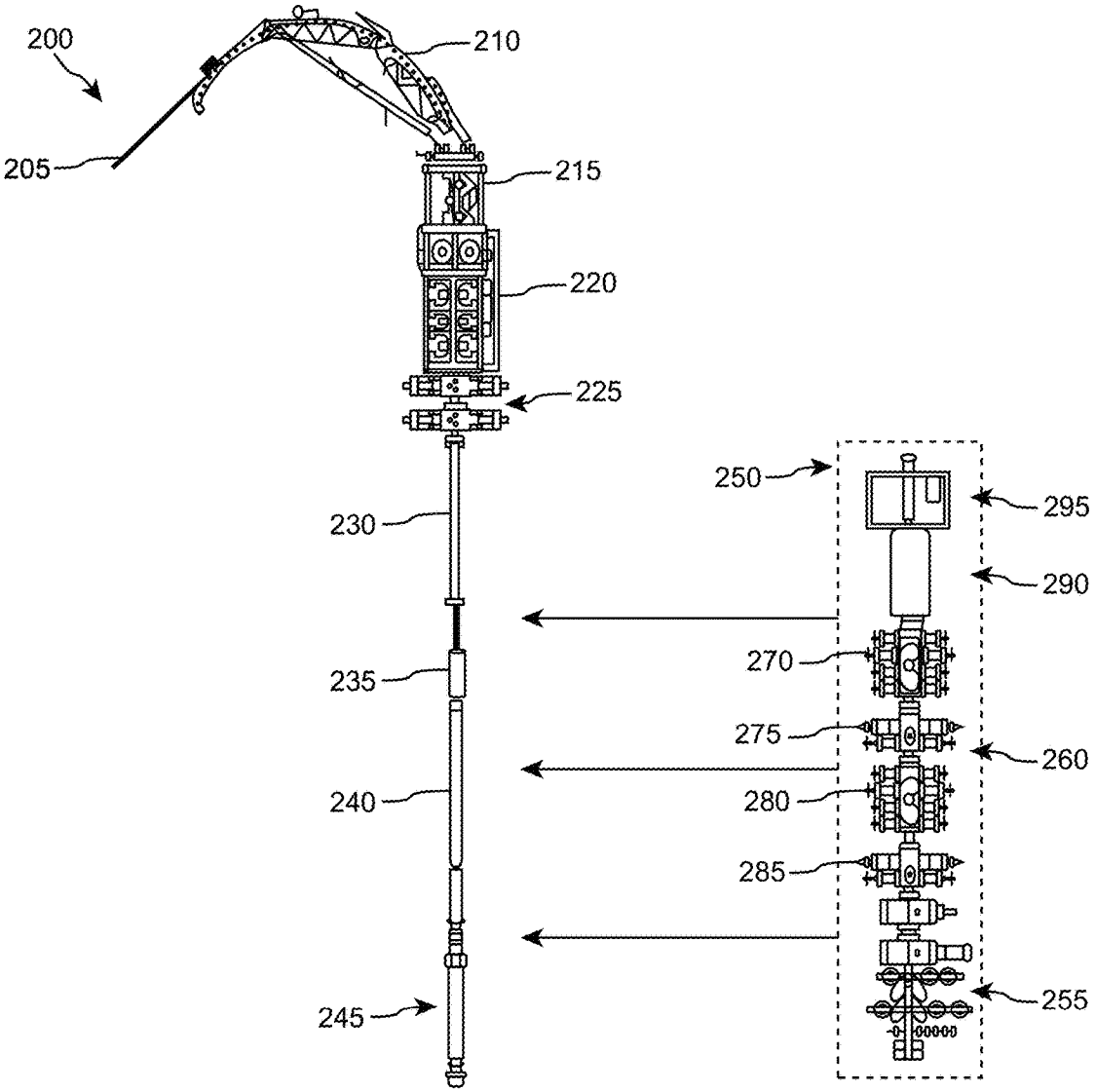
FIG. 2 illustrates elements of a coiled tubing surface equipment spread and downhole assembly designed, manufactured and operated according to the disclosure.

FIG. 2 illustrates elements of a coiled tubing surface equipment spread and downhole assembly 200 designed, manufactured and operated according to the disclosure. In accordance with the disclosure, the coiled tubing surface equipment spread and downhole assembly 200 includes key components added to enable the deployment of multiple coiled tubing strings as a combined workstring. In the illustrated embodiment, the coiled tubing surface equipment spread and downhole assembly 200 is positioned proximate, if not partially within, a wellhead stack 250. The wellhead stack 250, in at least one embodiment, includes a typical well Christmas tree 255, a primary well control stack 260, an annular blow out preventer (BOP) 290, and an optional work window 295. In at least one embodiment, such as that shown, the primary well control stack 260 includes a first quad BOP 270 for a first coiled tubing string size, a first dual combi BOP 275 for the first coiled tubing string size, a second quad BOP 280 for a second coiled tubing string size, and a second dual combi BOP 285 for the second coiled tubing string size. To the extent a single size coiled tubing string (e.g., single outer diameter coiled tubing string) is used for the first and second reels, the primary well control stack 260 could employ just the first quad BOP 270 and the first dual combi BOP 275.

In the illustrated embodiment, the coiled tubing surface equipment spread and downhole assembly 200 additionally includes coiled tubing string 205 extending over a coiled tubing guide arch 210 and into the wellhead stack 250. The coiled tubing surface equipment spread and downhole assembly 200 additionally includes an optional pipe straightener 215, as well as a coiled tubing injector 220 for injecting the coiled tubing 205 into the wellhead stack 250. In at least one embodiment, the coiled tubing surface equipment spread and downhole assembly 200 employs only a single injector set-up. The coiled tubing surface equipment spread and downhole assembly 200 may additionally include one or more coiled tubing strippers 225. The example shown uses a set of ram type stripper assemblies (though over under, annular, ram type "sidewinder" strippers and/or any combination of strippers may be used) to allow an annular seal to be maintained while moving the work-string in/out of the well in a live well scenario. A sidewinder stripper may be substituted with a set of stripping rams from a hydraulic workover unit or annular blowout preventers to enable the same capability while still accommodating multiple ODs. In the illustrated embodiment, the coiled tubing surface equipment spread and downhole assembly 200 includes two coiled tubing strippers 225 (e.g., one for each size of coiled tubing string). However, other embodiments may exist wherein a single coiled tubing stripper 225 is used, for example if a single size outer diameter coiled tubing string is used for the first and second reels. In the illustrated embodiment, the coiled tubing surface equipment spread and downhole assembly 200 additionally includes a lubricator 230, a connector 235, an optional trip-out safety valve 240, and a bottom hole assembly (BHA) 245. In at least one embodiment, the BHA 245 is a milling assembly coupled to a downhole end of the coiled tubing 205.

Figure 3:
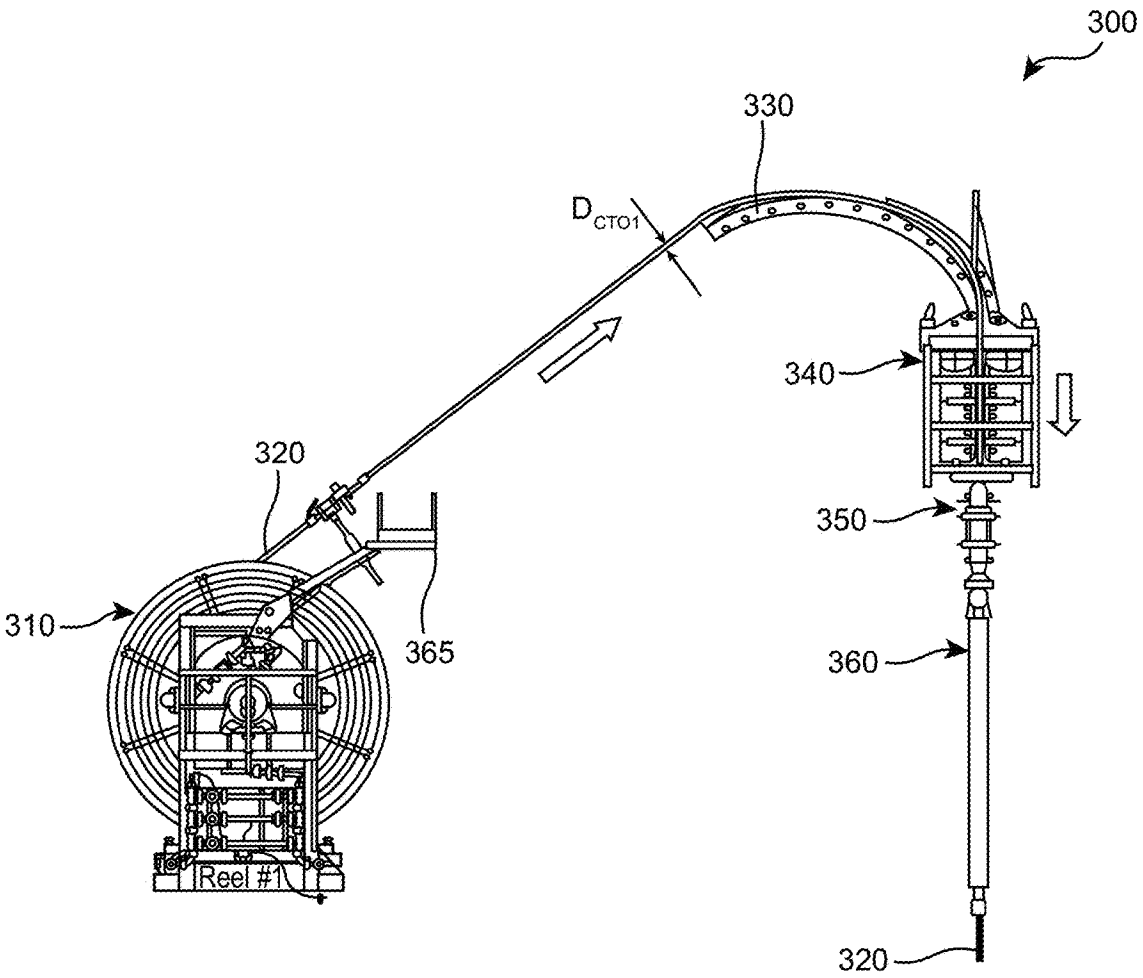
FIGS. 3 through 14 illustrate a method for connecting coiling tubing strings in accordance with one or more embodiments of the disclosure.

FIGS. 3 through 14 illustrate a method for connecting coiling tubing strings in accordance with one or more embodiments of the disclosure. With initial reference to FIG. 3, illustrated is one embodiment of a workflow 300 method for connecting coiled tubing strings designed, manufactured and operated according to one or more embodiments of the disclosure. The workflow 300 illustrated in FIG. 3 initially includes a first coiled tubing reel 310. In at least one embodiment, as shown, the first coiled tubing reel 310 includes a first coiled tubing string 320 placed thereon. In at least one embodiment, as shown, the first coiled tubing string 320 is wound around the first coiled tubing reel 310. The first coiled tubing string 320 may comprise many different coiled tubing types and sizes and remain within the purview of the disclosure. Nevertheless, in at least one embodiment, the first coiled tubing string 320 has a first coiled tubing outside diameter ($D_{CTO1}$) as well as a first coiled tubing inside diameter ($D_{CTI1}$).

The workflow 300 illustrated in FIG. 3 additionally includes a coiled tubing guide arch 330, which in the embodiment illustrated is coupled to a coiled tubing injector 340. The coiled tubing guide arch 330 and the coiled tubing injector 340 may be any guide arch or coiled tubing injector currently known or hereafter discovered without departing from the present disclosure. Coupled to the coiled tubing injector 340, in the illustrated embodiment, is a coiled tubing stripper 350. In the illustrated embodiment, a single coiled tubing stripper 350 is employed. Nevertheless, in other embodiments, two or more coiled tubing strippers 350 may be used. In at least one embodiment, a lubricator 360 is coupled downhole of the coiled tubing stripper 350.

The workflow 300 illustrated in FIG. 3 is configured as if it were just rigged up, and thus the first coiled tubing reel 310 is substantially full of the first coiled tubing string 320. The workflow 300 of FIG. 3 begins with an operator rigging up the coiled tubing guide arch 330, the coiled tubing injector 340, the coiled tubing stripper 350, and the lubricator 360, in addition to any other components that might be required. The operator may then run a downhole end of the first coiled tubing string 320 over the coiled tubing guide arch 330, and then stab the downhole end of the first coiled tubing string 320 into the coiled tubing injector 340, the coiled tubing stripper 350, and the lubricator 360. With the downhole end of the first coiled tubing string 320 stabbed into the coiled tubing injector 340, and the coiled tubing stripper 350, a crane (not shown) may raise the items, as per normal coiled tubing rigging methods. Typically these items are ultimately lifted and held in place with the help of a crane (not shown), but other lifting means are within the scope of the disclosure.

Thereafter, the operator may run the first coiled tubing string 320 down to ground level and assemble a BHA to the end thereof, for example starting with a premium connector. Subsequent thereto, the operator may add any remaining BHA components, for example considering a power reach trip-in safety valve as DFCV back-up. Then, the operator may rig up the coiled tubing injector 340 to the wellhead stack (not shown) as per normal coiled tubing rigging methods, secure the wellhead stack, run a pressure test, equalize and then open the well. With the workflow 300 in place, and the pressure test complete, the first coiled tubing string 320 may be lowered (e.g., run) into the wellbore, for example using the coiled tubing injector 340, until only a few last wraps of the first coiled tubing string 320 remain on the first coiled tubing reel 310.

Figure 4:
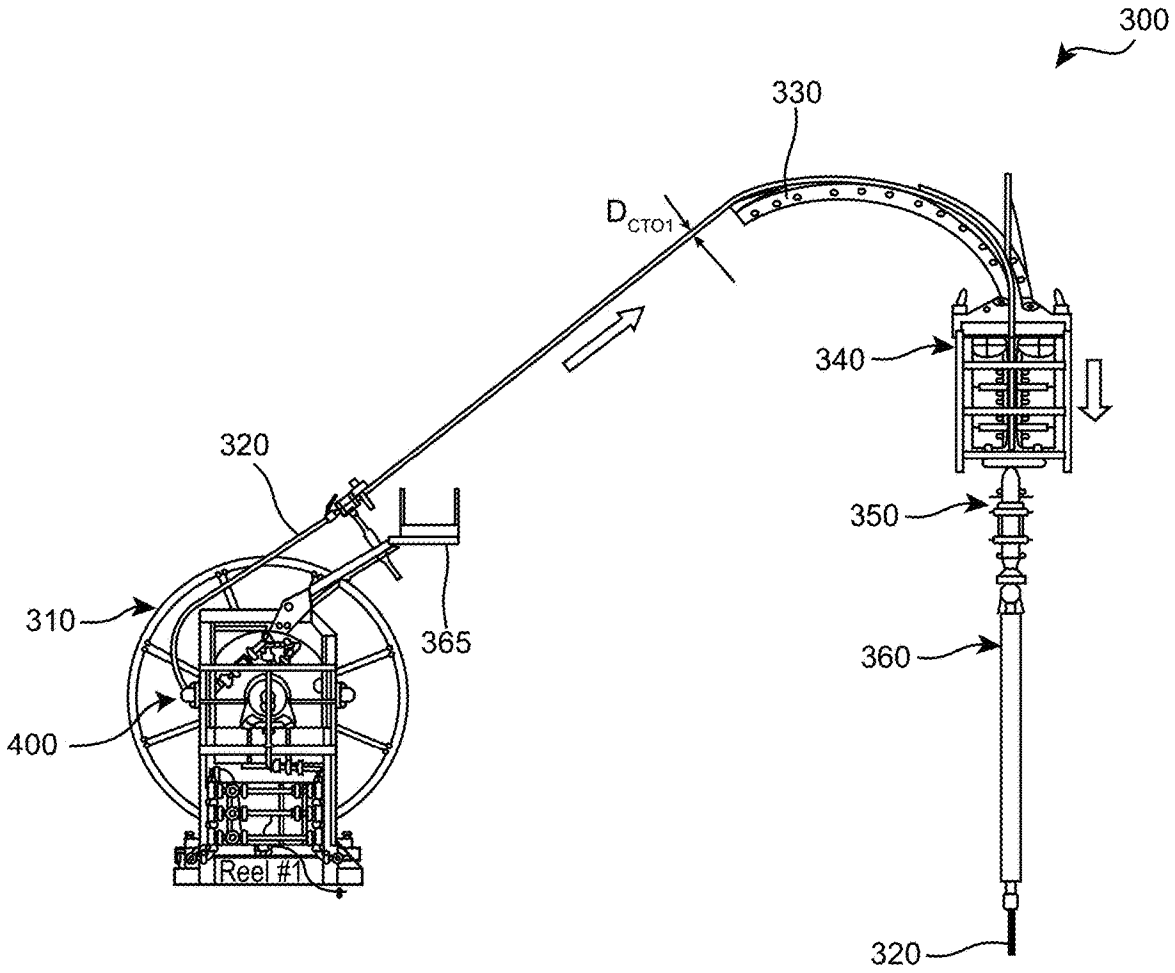

Turning to FIG. 4, the workflow 300 might continue with the operator stopping displacement of the first coiled tubing string 320 when no more wraps of the first coiled tubing string 320 remain around the first coiled tubing reel 310. Thereafter, the operator could monitor/ensure that the check valves at the BHA are holding well pressure, and then the operator could close the slip/seal rams in the first coiled tubing string 320 blowout preventers and then bleed-off the pressure from the first coiled tubing string 320. Then, the operator could secure the first coiled tubing string 320 in place with a hydraulically actuated mechanical arm 365 connected to the first coiled tubing reel 310, for example between the drum of the first coiled tubing reel 310 and the level wind. The operator could then disconnect the uphole end of the first coiled tubing string 320 from the first coiled tubing reel 310.

Figure 4A:
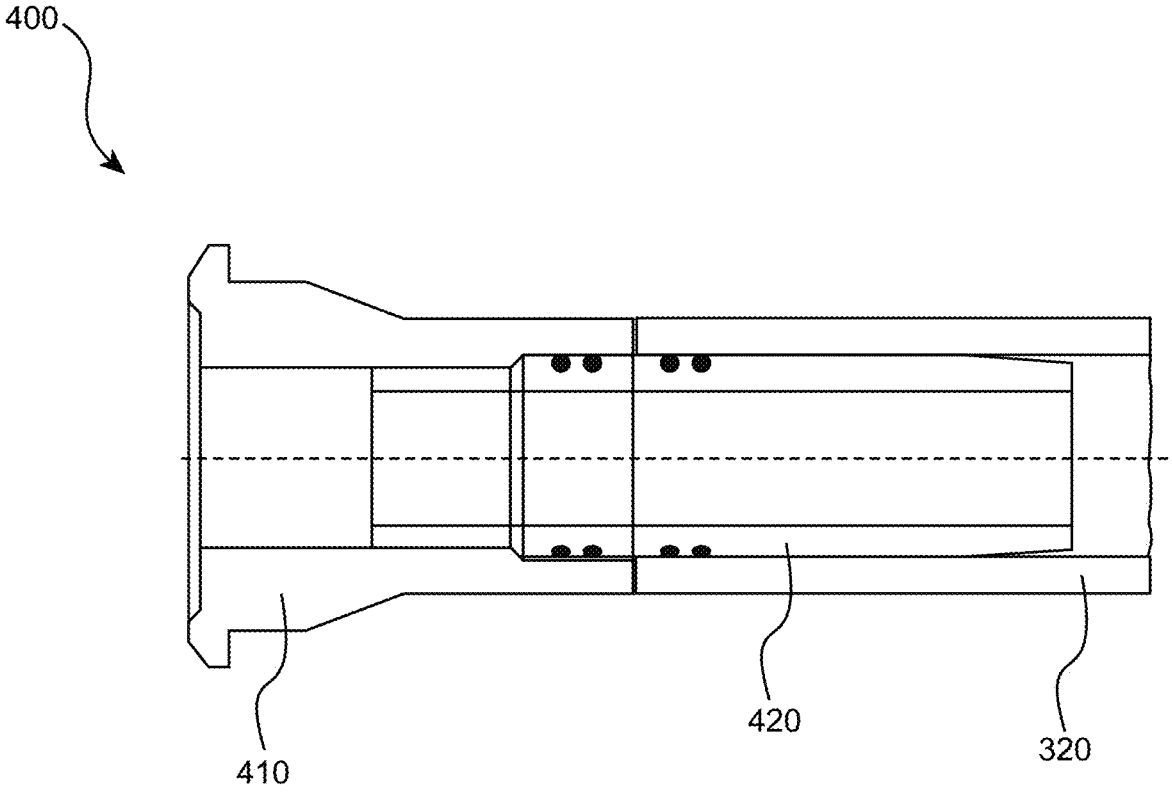

Turning briefly to FIG. 4A, with continued reference to FIG. 4, illustrated is one embodiment of a connection 400 between the first coiled tubing reel 310 and an uphole end of the first coiled tubing string 320. In the illustrated embodiment of FIG. 4A, the connection 400 includes a reel connector nut 410 coupled to the first coiled tubing reel 310, as well as a connector insert 420 positioned partially within the uphole end of the first coiled tubing string 320. In the illustrated embodiment, the reel connector nut 410 removable engages with the connector insert 420 to couple the first coiled tubing reel 310 and the uphole end of the first coiled tubing string 320. While the embodiment of FIG. 4A illustrates the connection 400 as a reel connector nut 410 and a connector insert 420, other embodiments exist employing a hammer union connection (e.g., at the modified 1502 hammer union) on the first coiled tubing reel 310. Thus, the workflow 300 is not limited to the use of a reel connector nut 410 or a hammer union, as other connection types may be employed as alternatives.

In the embodiment of FIGS. 4 and 4A, the workflow 300 requires getting into the first coiled tubing reel 310 for making and breaking the connection 400. In other examples, however, the first coiled tubing reel 310 might have a coiled tubing pigtail or other similar extension that extends radially outside the first coiled tubing reel 310 when the first coiled tubing string 320 is no longer wound around the first coiled tubing reel 310. In at least one embodiment, the coiled tubing pigtail extends the connection 400 by up to about 30.5 meters (e.g., up to about 100 feet), and for example past the hydraulically actuated mechanical arm. In this embodiment, the connection 400 would be radially outside of the first coiled tubing reel 310, and thus rendering it easier to make and/or break the connection 400. In at least one embodiment, the connection 400 can be installed by the coiled tubing string manufacturer. In this case, the first coiled tubing reel 310 may be modified to have a flat or recessed area to accommodate the straight rigid connector without bending it significantly.

Figure 5:
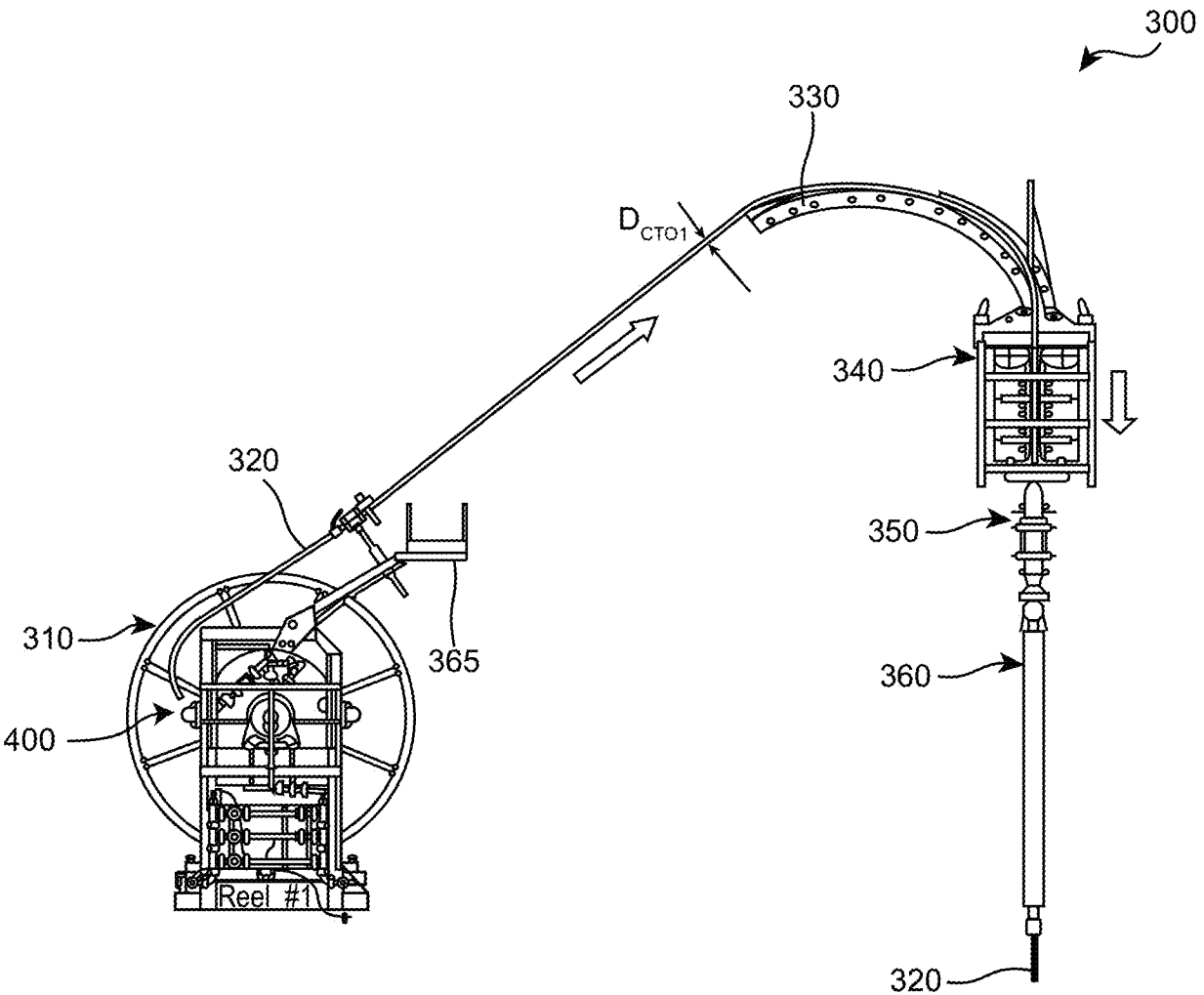
Figure 5A:
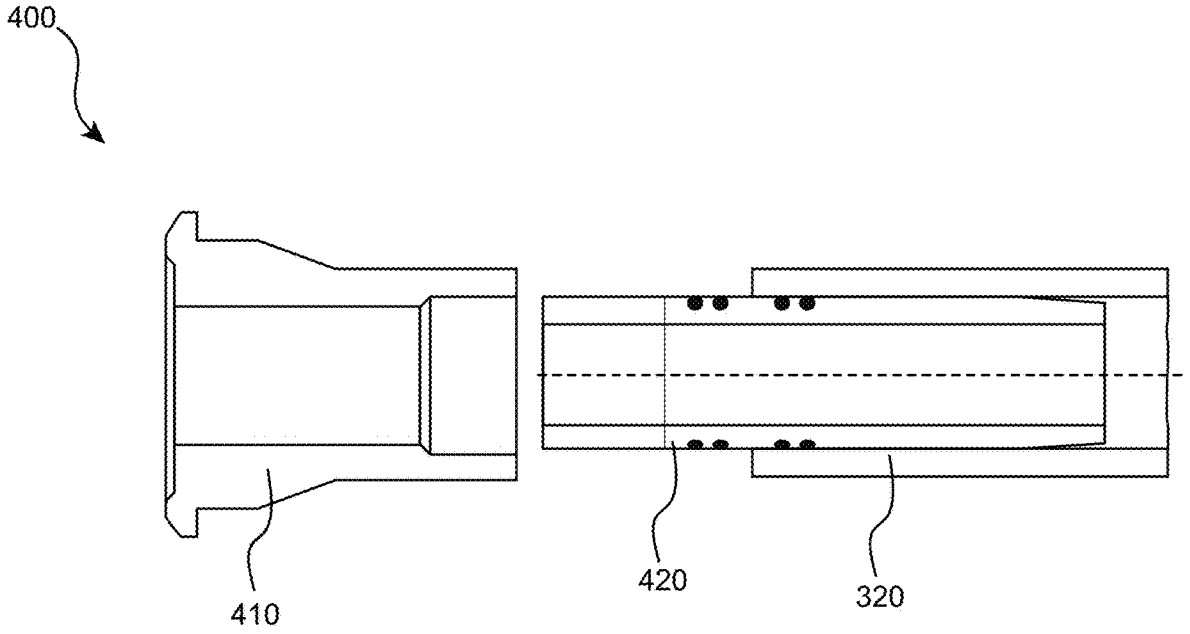

Turning to FIG. 5, the workflow 300 continues by disconnecting the uphole end of the first coiled tubing string 320 from the first coiled tubing reel 310. In at least one embodiment, an uphole end of the first coiled tubing string 320 remains outside of the wellbore when the first coiled tubing string 320 is disconnected from the first coiled tubing reel 310. Again, this could be accomplished by breaking the connection 400. With a brief reference to FIG. 5A, illustrated is the connection 400 of FIG. 4A in a disconnected state. Accordingly, the first coiled tubing string 320 is disconnected from the first coiled tubing reel 310, but for the hydraulically actuated mechanical arm 365.

Figure 6:
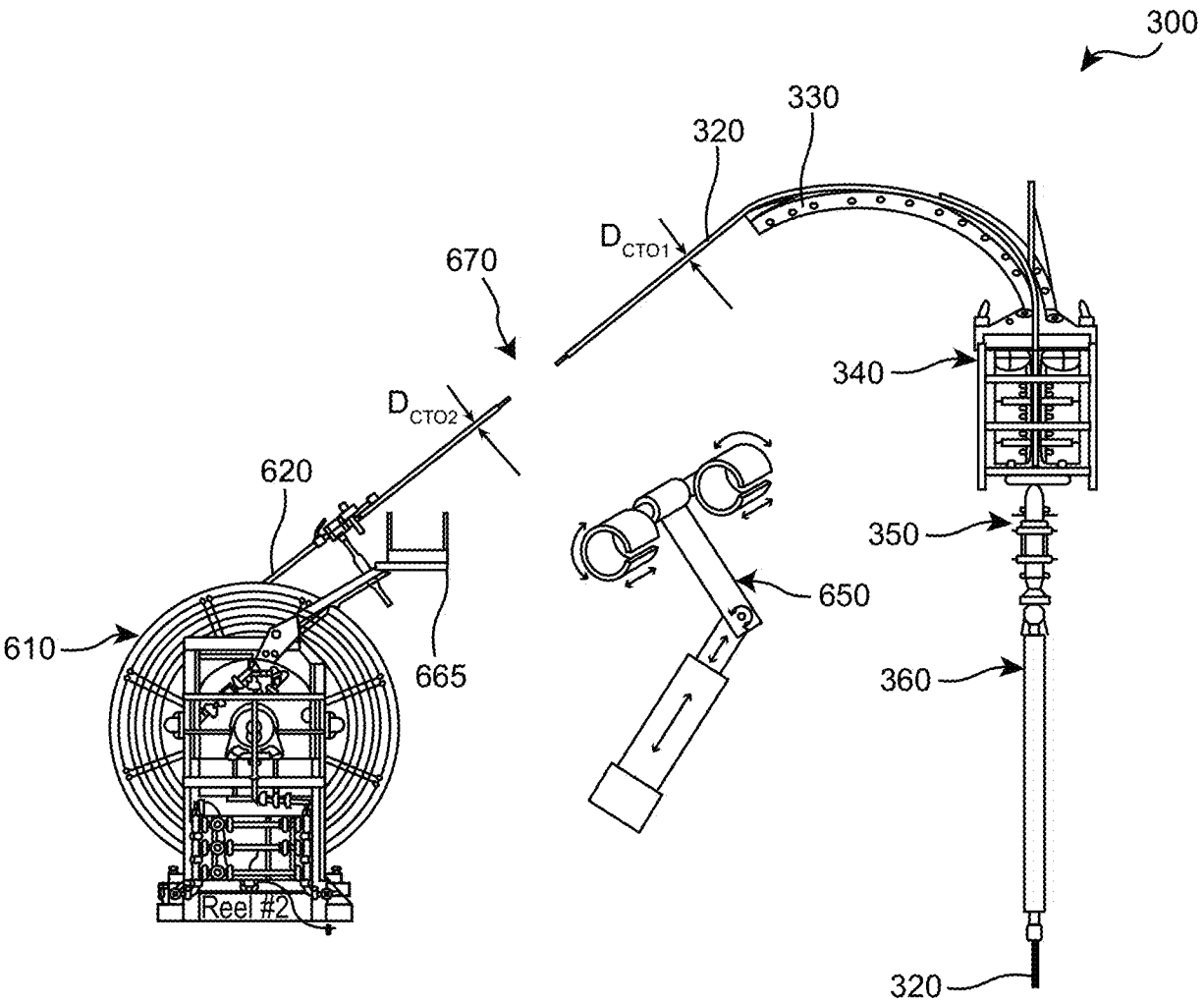

Turning to FIG. 6, the workflow 300 continues with the operator securing the first coiled tubing string 320. In one or more embodiments, the first coiled tubing string may be secured using a crane/chains, coiled tubing clamps, or any other known or hereafter discovered method. The operator could then release the uphole end of the first coiled tubing string 320 from the hydraulically actuated mechanical arm 365 installed between the first coiled tubing reel 310 and the level wind, all the while securing the remainder of the first coiled tubing string 320 relative to the coiled tubing injector 340. The operator could then remove the first coiled tubing reel 310 and position a second coiled tubing reel 610 in its place, or alternatively move the uphole end of the first coiled tubing string 320 to align with a downhole end of a second coiled tubing string 620 positioned on the second coiled tubing reel 610, which may or may not already exist. In the illustrated embodiment, a second hydraulically actuated mechanical arm 665 associated with the second coiled tubing reel 610 may be used to hold the downhole end of the second coiled tubing string 620 in place.

In at least one embodiment, as shown, the second coiled tubing string 620 is wound around the second coiled tubing reel 610. The second coiled tubing string 620 may comprise many different coiled tubing types and sizes and remain within the purview of the disclosure. Nevertheless, in at least one embodiment, the second coiled tubing string 620 has a second coiled tubing outside diameter ($D_{CTO2}$) as well as a second coiled tubing inside diameter ($D_{CTI2}$). One or both of the second coiled tubing outside diameter ($D_{CTO2}$) and the second coiled tubing inside diameter ($D_{CTI2}$) may be different from one or both of the first coiled tubing outside diameter ($D_{CTO1}$) and first coiled tubing inside diameter ($D_{CTI1}$). For example, in certain embodiments the second coiled tubing outside diameter ($D_{CTO2}$) and the second coiled tubing inside diameter ($D_{CTI2}$) are respectively greater than the first coiled tubing outside diameter ($D_{CTO1}$) and first coiled tubing inside diameter ($D_{CTI1}$).

With continued reference to FIG. 6, the workflow 200 continues with the operator optionally using telescopic/articulated pipe handling equipment 650 designed, manufactured and operated according to the disclosure to bring the uphole end of the first coiled tubing string 320 and the downhole end of the second coiled tubing string 620 together. The telescopic/articulated pipe handling equipment 650 could also be used to align the uphole end of the first coiled tubing string 320 and the downhole end of the second coiled tubing string 620, for example to make up a working connector 670 (e.g., by coupling a connector nut to a first coiled tubing connector insert positioned partially within the uphole end of the first coiled tubing string 320 and a second coiled tubing connector insert positioned partially within the downhole end of the second coiled tubing string 620). Alternatively, the operator could position a man basket to make up the working connector 670 between the first and second coiled tubing strings 320, 620.

Figure 6A:
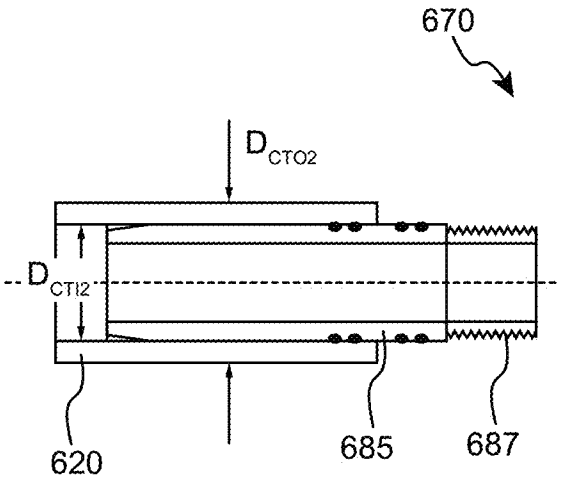
Figure 6A:
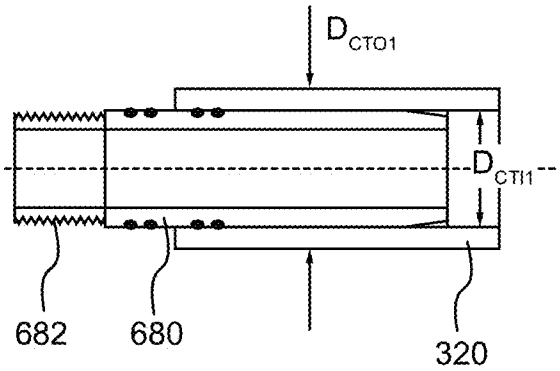

Turning briefly to FIG. 6A, with continued reference to FIG. 6, illustrated is one embodiment of portions of a working connector 670 designed, manufactured and operated according to one or more embodiments of the disclosure. In the embodiment of FIG. 6A, the uphole end of the first coiled tubing string 320 and the downhole end of the second coiled tubing string 620 are positioned proximate one another. Further to this embodiment, the working connector 670 at least partially includes a first coiled tubing connector insert 680 positioned partially within the uphole end of the first coiled tubing string 320, and a second coiled tubing connector insert 685 positioned partially within the downhole end of the second coiled tubing string 620. In the illustrated embodiment of FIG. 6A, the first coiled tubing connector insert 680 and the second coiled tubing connector insert 685 are dimpled connectors having one or more sealing elements disposed on an outer surface thereof.

Figure 7:
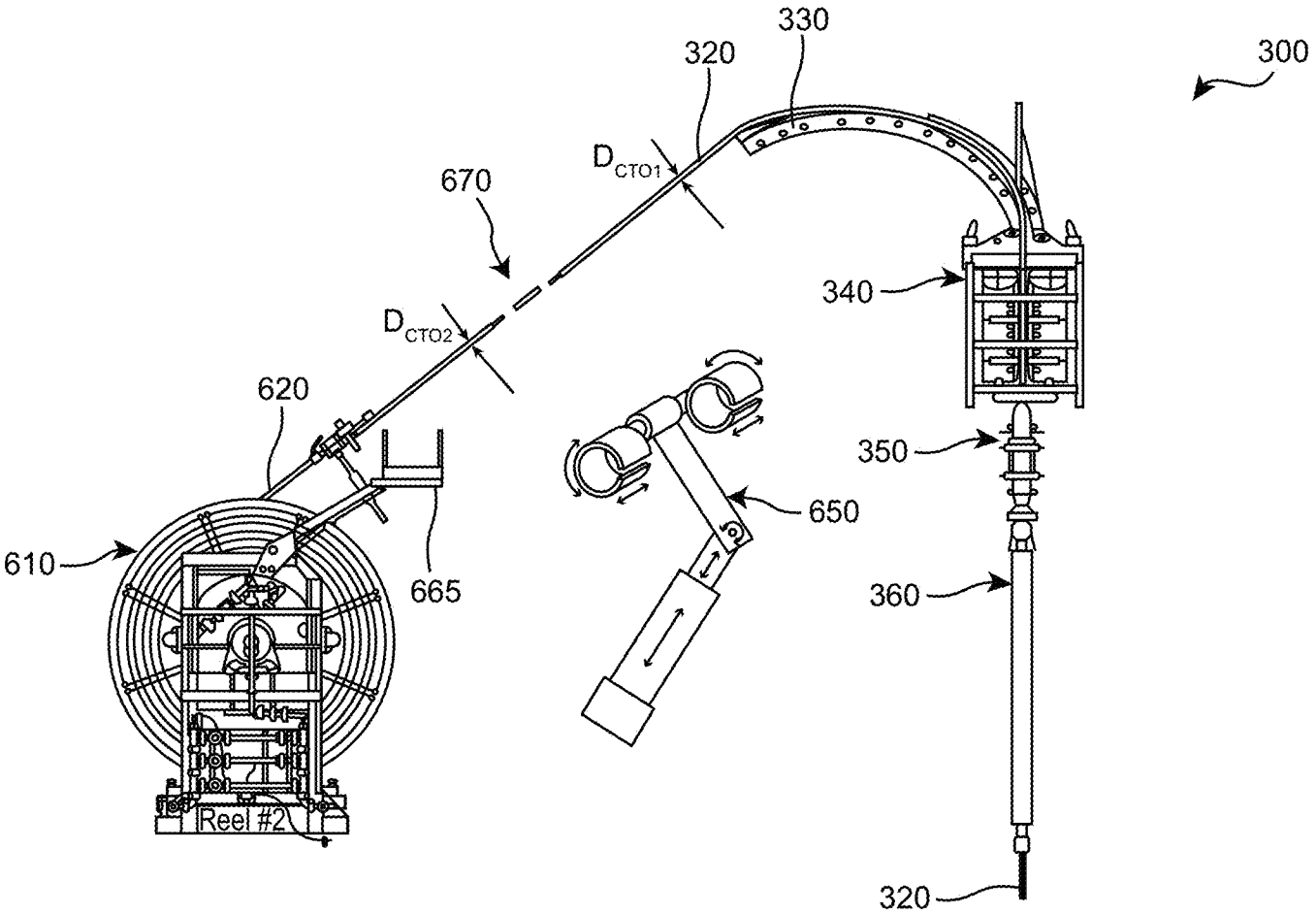
Figure 7A:
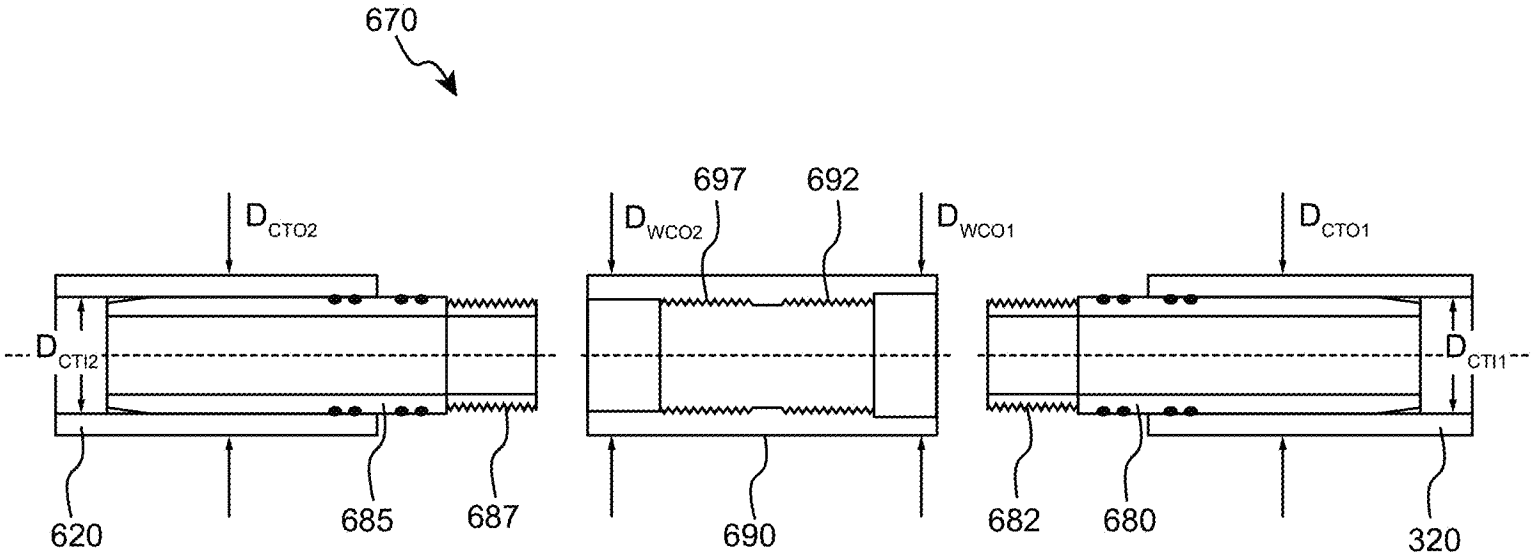

Turning to FIG. 7, the workflow 300 continues with the operator continuing to make up the working connector 670. Turning to FIG. 7A, with continued reference to FIG. 7, illustrated is an unassembled working connector 670. As shown, the working connector 670 includes a connector nut 690 configured to couple the first coiled tubing connector insert 680 and the second coiled tubing connector insert 685. In at least one embodiment, the connector nut 690 has a first set of connector nut threads 692 coupleable to a first set of connector insert threads 682 of the first coiled tubing connector insert 680, and a second set of connector nut threads 697 coupleable to a second set of connector insert threads 687 of the second coiled tubing connector insert 685. In one embodiment of the disclosure, the first set of connector nut threads 692 and the second set of connector nut threads 697 are opposite handedness, such that as the connector nut 690 is spun in a direction about the first and second coiled tubing connector inserts 680, 685 the first and second coiled tubing connector inserts 680, 685 are brought toward one another to form a combined coiled tubing string, and vice-versa.

Figure 8:
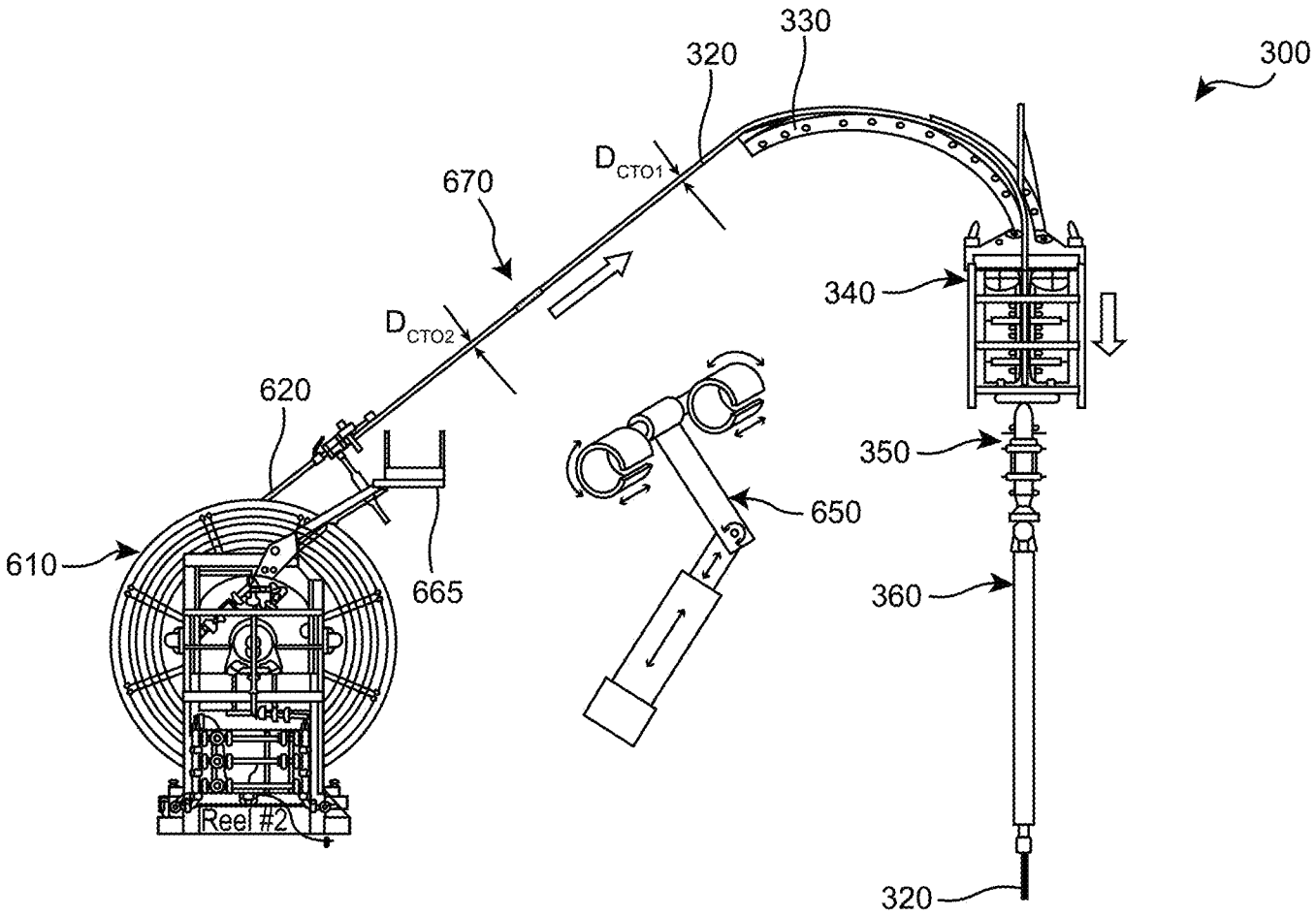

Turning to FIG. 8, the workflow 300 continues with the operator completing the make-up of the working connector 670, resulting in a combined coiled tubing string 810. In at least one embodiment, the uphole end of the first coiled tubing string 320 is coupled to a downhole end of a second coiled tubing string 620 while the uphole end of the first coiled tubing string 320 remains outside of the wellbore. In yet another embodiment, the uphole end of the first coiled tubing string 320 is coupled to a downhole end of a second coiled tubing string 620 while the uphole end of the first coiled tubing string 320 remains within the coiled tubing injector 340. In at least one embodiment, the uphole end of the first coiled tubing string 320 is coupled to a downhole end of a second coiled tubing string 620 without rigging down or rigging up the coiled tubing injector 340.

Figure 8A:
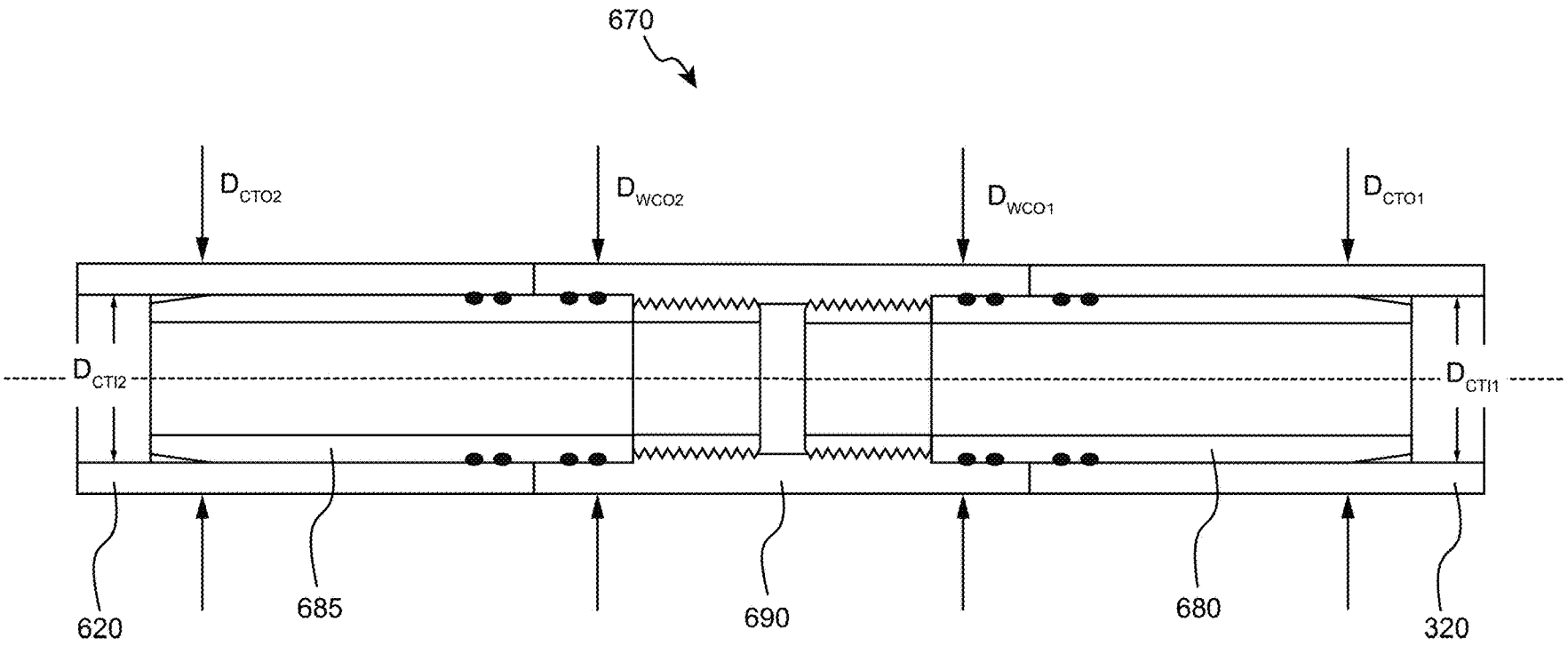

Turning to FIG. 8A, with continued reference to FIG. 8, illustrated is an assembled working connector 670. In the illustrated embodiment of FIG. 8A, it is shown that the transition from the first coiled tubing string 320, to the connector nut 690, and then to the second coiled tubing string 620 is smooth. In the illustrated embodiment, this is achieved, as the first coiled tubing string 320 has the first coiled tubing outside diameter ($D_{CTO1}$), the second coiled tubing string 620 has a second similar coiled tubing outside diameter ($D_{CTO2}$), and the working connector 670 includes a first working connector outside diameter ($D_{WCO1}$) proximate the first coiled tubing string 320 and a second working connector outside diameter ($D_{WC2}$) proximate the second coiled tubing string 620 that are both similar to the first coiled tubing outside diameter ($D_{CTO1}$) and the second similar coiled tubing outside diameter ($D_{CTO2}$). Notwithstanding the foregoing, other embodiments may exist wherein the connector nut 690 could have a larger or smaller working connector outside diameter than the first coiled tubing string 320 and/or second coiled tubing string 620. In this embodiment, the transition would not be as smooth as that shown in FIG. 8C.

It should be noted that while threads have been described and illustrated as connecting the first and second tubing connector inserts 680, 685 and the connector nut 690, other types of connections might be used. For example, two or more set screws could be used to connect the first and second tubing connector inserts 680, 685 and the connector nut 690. In yet another embodiment, a series of J-slots and pins could be used to couple the first and second tubing connector inserts 680, 685 and the connector nut 690. Accordingly, the present disclosure should not be limited to any specific type of connection.

Returning to FIG. 8, with the working connector 670 fully made up, the operator may then perform a pull test and pressure test on the combined coil tubing string. Note that the telescopic/articulated pipe handling equipment 650 may be capable of performing the pull test if equipped with a piston (e.g., hydraulic piston) between either clamping end. If the working connector 670 is equipped with test ports, a pressure test may be completed with a small hand pump. The operator may then open the blowout preventer slip and seal rams.

Figure 8B:
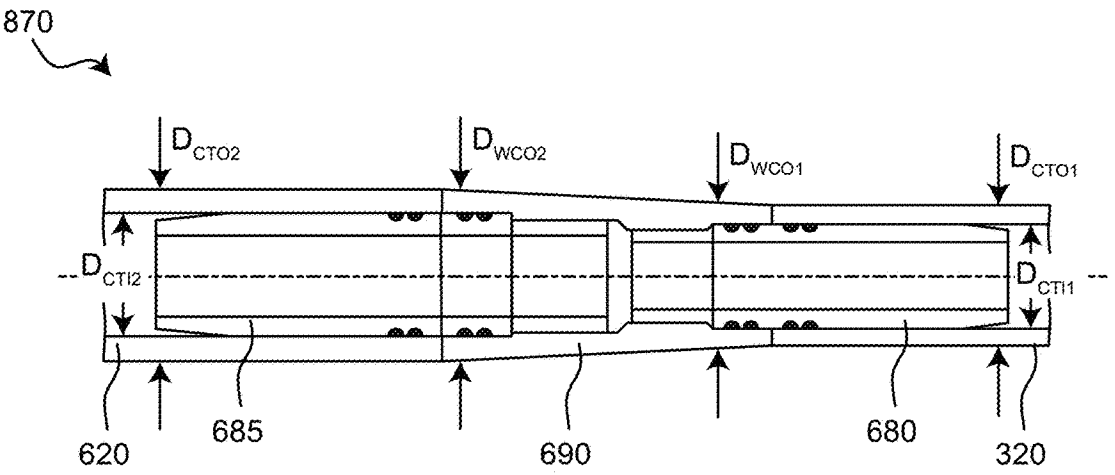

Turning briefly to FIG. 8B, illustrated is an alternative embodiment of a working connector 870 designed, manufactured and operated according to the disclosure. In the embodiment of FIG. 8B, the first coiled tubing outside diameter ($D_{CTO1}$) of the first coiled tubing string 320 and the second coiled tubing outside diameter ($D_{CTO2}$) of the second coiled tubing string 620 are not similar to one another. In fact, in the embodiment of FIG. 8B, the first coiled tubing string 320 has a first coiled tubing outside diameter ($D_{CTO1}$) and the second coiled tubing string 620 has a second greater coiled tubing outside diameter ($D_{CTO2}$). Further to the embodiment of FIG. 8B, the working connector 670 includes a first working connector outside diameter ($D_{WCO1}$) proximate the first coiled tubing string 320 and a second greater working connector outside diameter ($D_{WC2}$) proximate the second coiled tubing string 620, which are both similar to the first coiled tubing outside diameter ($D_{CTO1}$) and the second similar coiled tubing outside diameter ($D_{CTO2}$), respectively. Accordingly, an outside diameter transition of the working connector 670 between the first working connector outside diameter ($D_{WCO1}$) and the second greater working connector outside diameter ($D_{WCO2}$) is a smooth outside diameter transition. This smooth outside diameter transition may be important for the working connector 670 to feed through the coiled tubing injector 340.

Figure 8C:
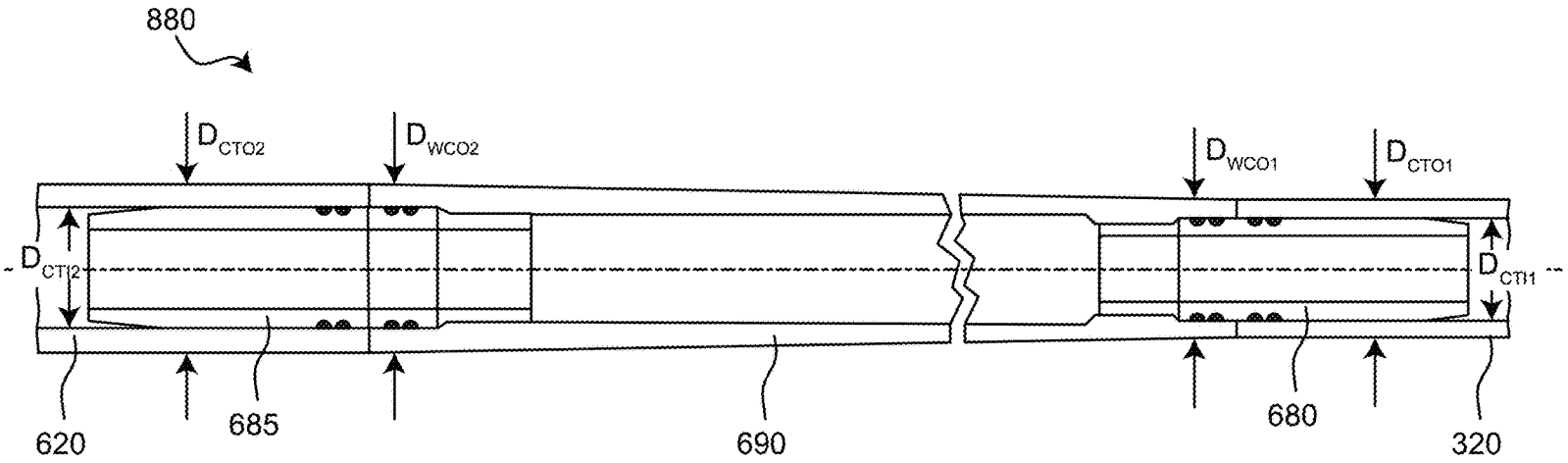

Turning briefly to FIG. 8C, illustrated is an alternative embodiment of a working connector 880 designed, manufactured and operated according to one or more embodiments of the disclosure. The working connector 880 is similar in many respects to the working connector 870 illustrated in FIG. 8B. The working connector 880 differs, for the most part, from the working connector 870, in that the working connector 880 includes a much longer smooth outside diameter transition.

Figure 9:
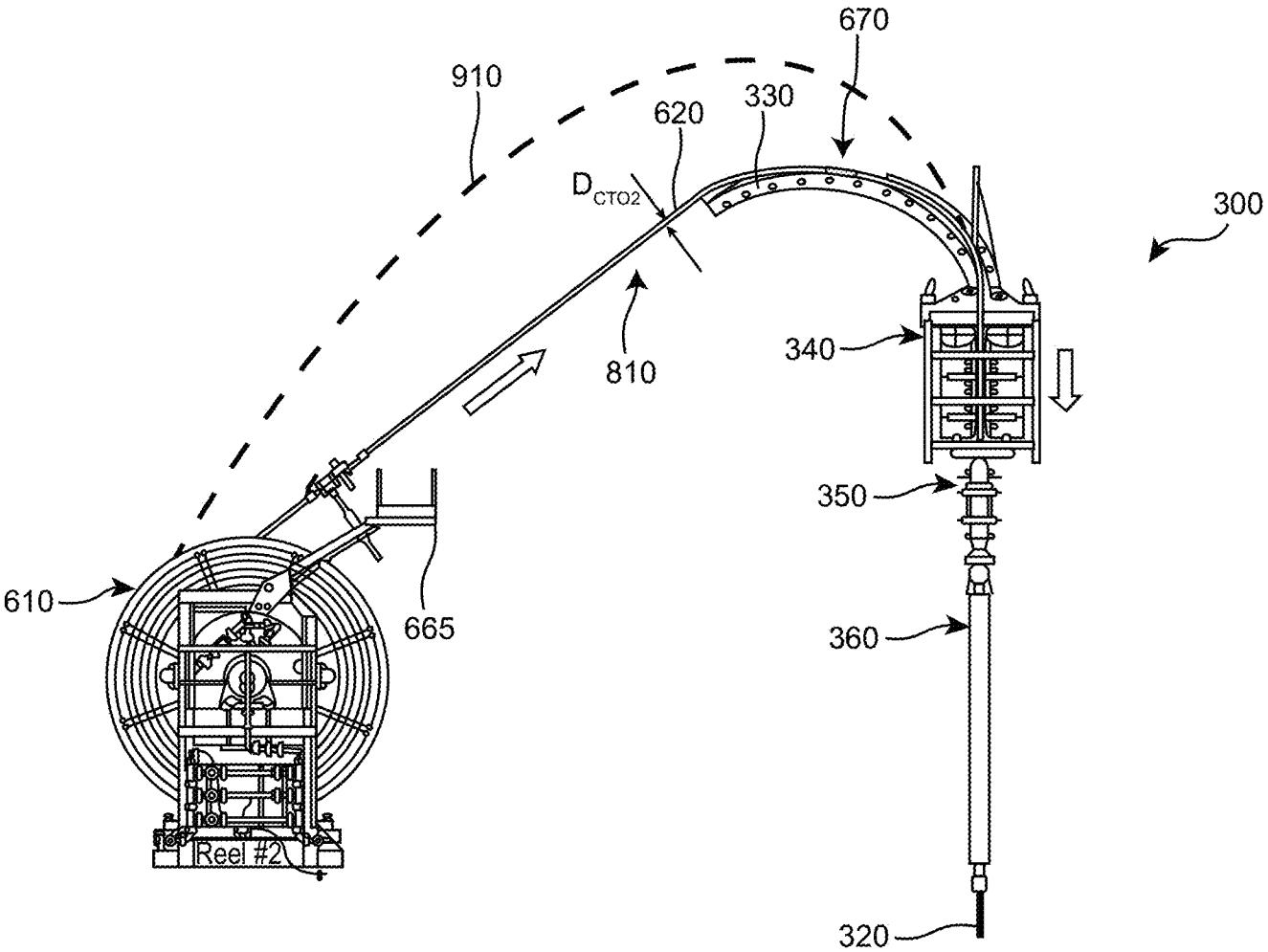

Turning to FIG. 9, the workflow 300 continues with the operator passing the working connector 670 over the tubing guide arch 330. In one embodiment, the working connector 670 has a short enough length that it easily travels over the tubing guide arch 330. In another embodiment, the working connector 670 has a longer length that makes it difficult to travel over the tubing guide arch 330. In this embodiment, a reel back tension of the second coiled tubing reel 610 may be lowered (e.g., such that the second coiled tubing string 620 is exiting the second coiled tubing reel 610 faster than the combined coiled tubing string 810 is traveling through the coiled tubing injector 340), thus making the second coiled tubing string 620 arch as shown with the dotted line 910.

In at least one alternative embodiment, the combined coiled tubing string 810 may be guided with a crane and a roller clamp or basic sheave. For rig-ups involving towers, the sheave can be mounted on a support arm extended from the tower frame. Once the working connector 670 passes the tubing guide arch 330 and runs into the coiled tubing injector 340, the operator may remove the guide sheave/roller clamp.

Figure 10:
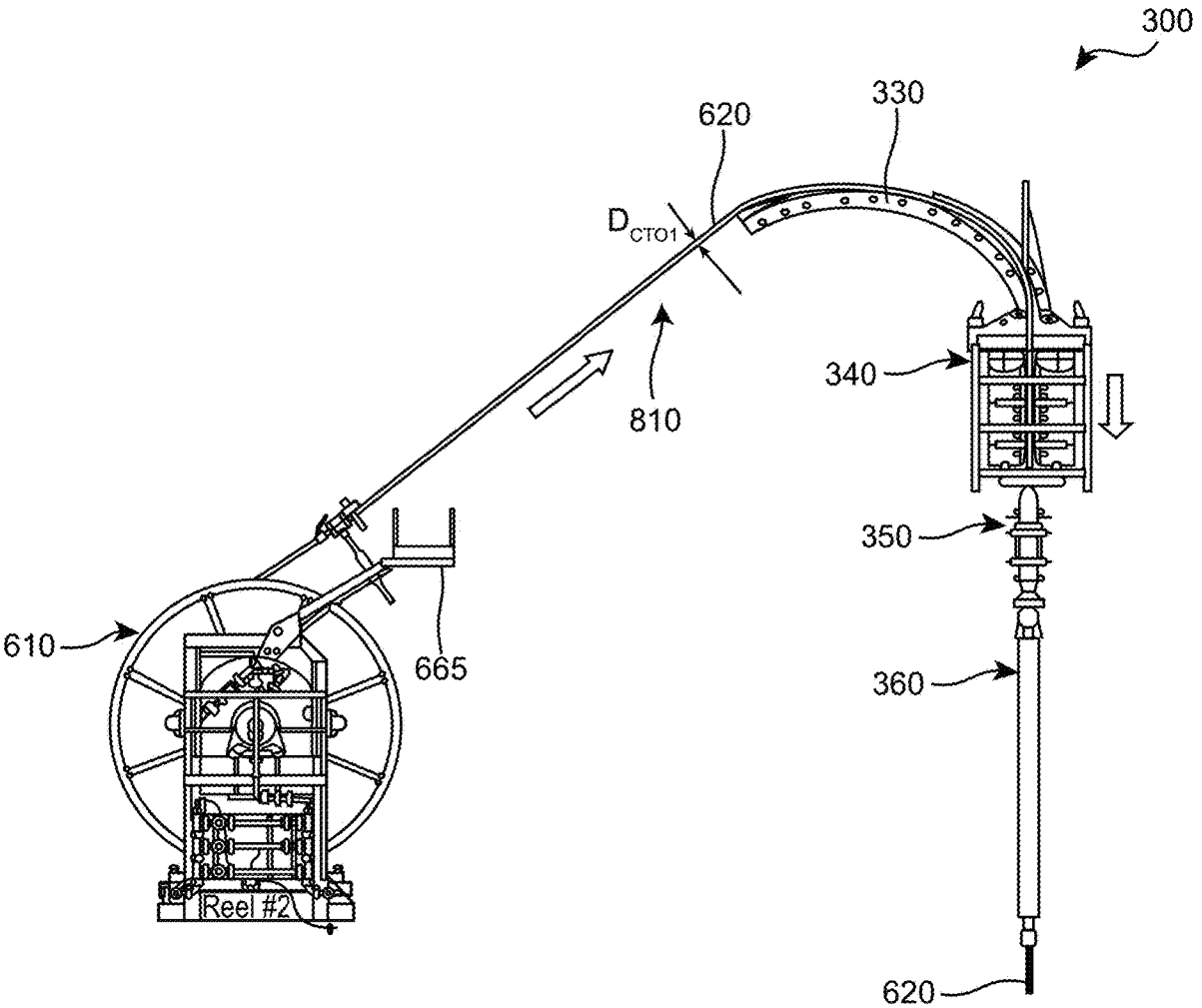

Turning to FIG. 10, the workflow 300 continues with the operator lowering (e.g., running) the combined coiled tubing string 810, including the second coiled tubing string 620, in the wellbore. Moreover, the operator is in a position to perform the necessary intervention, for example using a BHA as discussed above.

Figure 11:
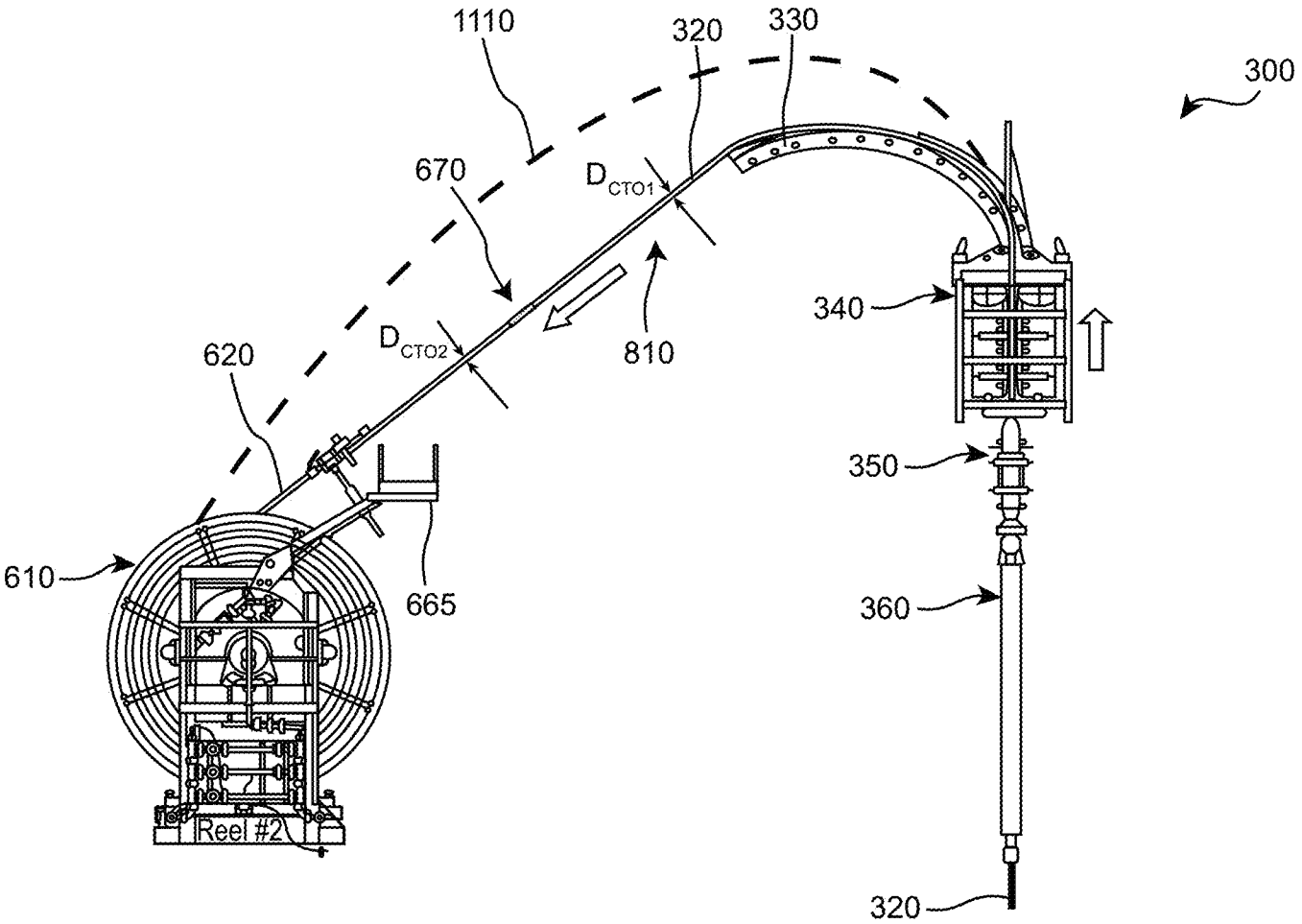

Turning to FIG. 11, the workflow 300 continues after the operator has performed the necessary intervention, for example with the operator withdrawing the combined coiled tubing string 810 out of the wellbore until the working connector is just uphole of the coiled tubing injector 340. The operator may then pass the working connector 670 over the coiled tubing guide arch 330, by once again lowering the reel back tension, for example making a coiled tubing arch, as shown by the dotted line 1110.

Figure 12:
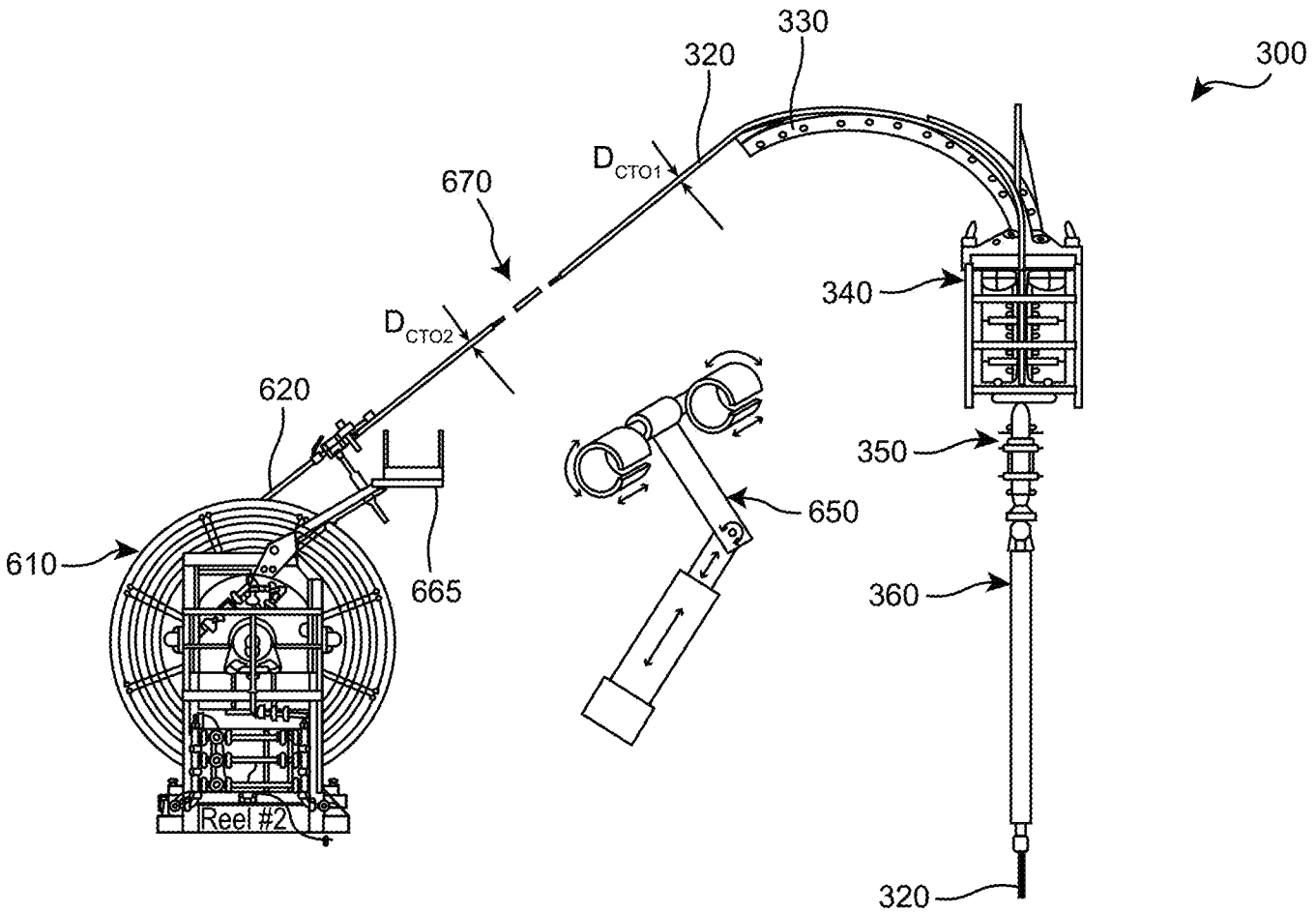

Turning to FIG. 12, the workflow 300 continues with the operator using the telescopic/articulated pipe handling equipment 650 to hold the uphole end of the first coiled tubing string 320 and the downhole end of the second coiled tubing string 620 together, as well as aligning the two. In at least one embodiment, a man basket may then be positioned to break the working connector 670. The operator could then remove the working connector 670, thereby separating the combined coiled tubing string 810 back into separate first and second coiled tubing strings 320, 620. Then the operator could secure the second coiled tubing string 620 with the second hydraulically actuated mechanical arm 665, and release second coiled tubing string 620 from the telescopic/articulated pipe handling equipment 650, while retaining grip on the first coiled tubing string 320.

Figure 13:
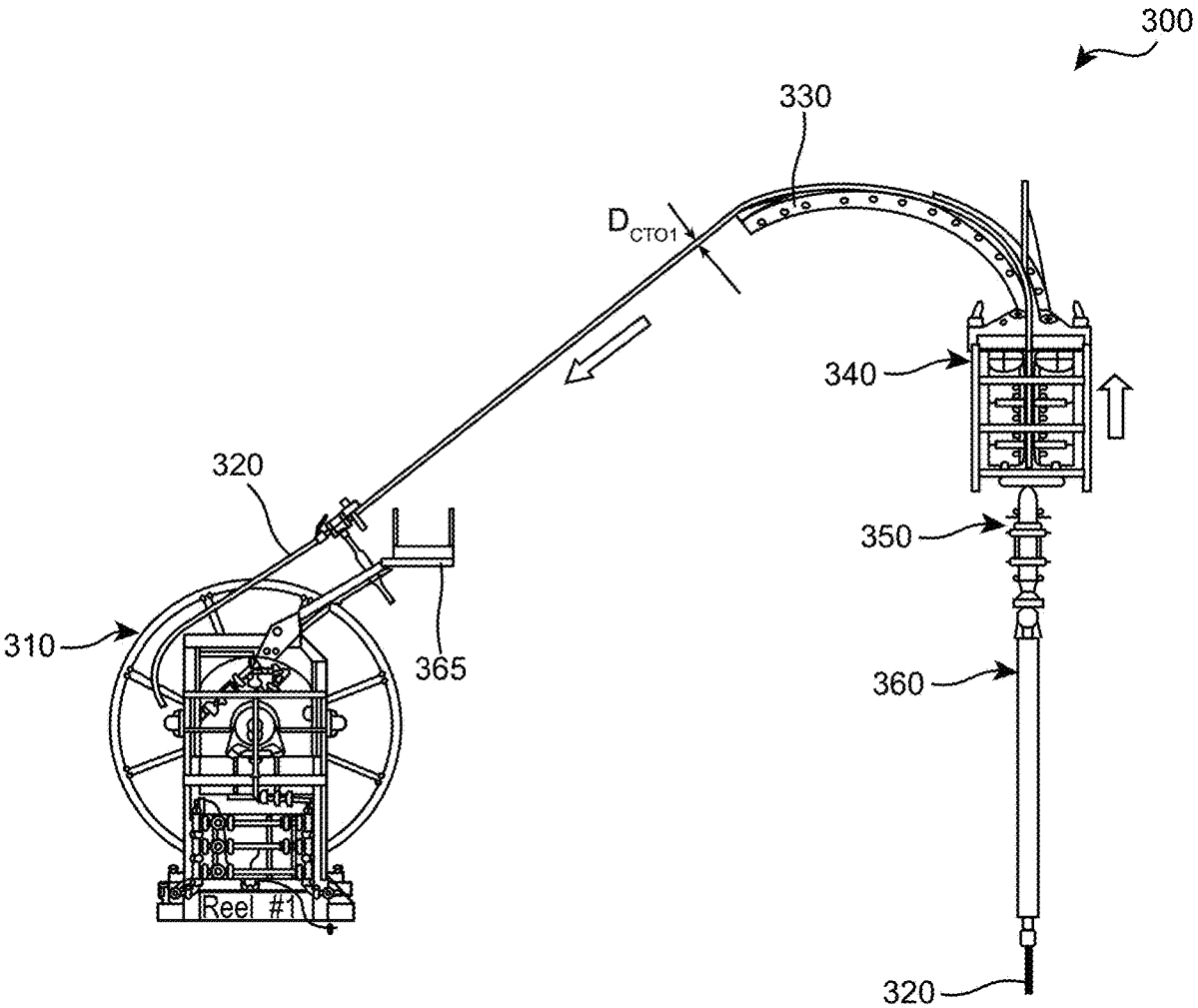

Turning to FIG. 13, the workflow 300 continues with the operator positioning the uphole end of the first coiled tubing string 320 relative to the first coiled tubing reel 310. The operator could then attach the connection 400, which in one embodiment includes the reel connector nut 410 coupled to the first coiled tubing reel 310, as well as a connector insert 420 positioned partially within the uphole end of the first coiled tubing string 320.

Figure 14:
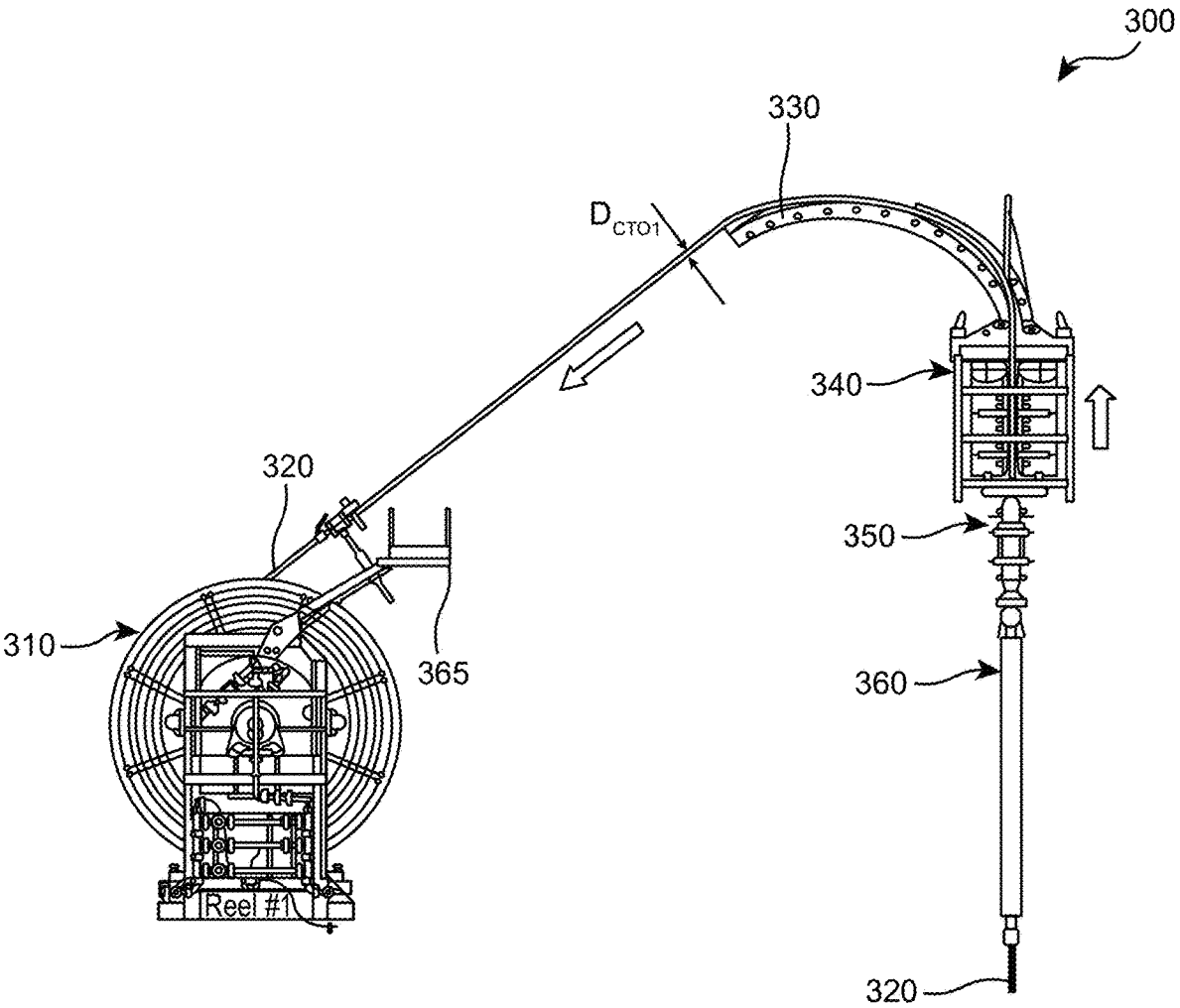

Turning to FIG. 14, the workflow 300 continues with the operator performing a pressure test, and then withdrawing (e.g., recovering) the remainder of the first coiled tubing string 320 by pulling it out of the wellbore. The well could then be shut in, for example with the pressure hole equipment stack and coiled tubing pressure bled down, riser disconnected, and bottom hole assembly removed. The workflow 300 may be complete at this state.

FIG. 15 illustrates a modified workflow 1500 method for guiding the working connector 670 over into the coiled tubing guide arch 330 and into the coiled tubing injector 340, for example using a crane and roller clamp 1510. This is different from the method disclosed above, which includes feeding coiled tubing off of the second coiled tubing reel 610 at a slightly faster rate than it is being run into hole by the coiled tubing injector 340. In this current method, the combined coiled tubing 810 will arc at an entry angle above the coiled tubing guide arch 330, so that the working connector 670 need not ride along the coiled tubing guide arch 330 radius.

FIG. 16 illustrates a modified workflow 1600 method for feeding the rigid connector past the guide arch, by incorporating a "flying gooseneck" 1610 similar to those used in catenary or vessel to deck spooling operations. The flying gooseneck radius may be sized to appropriately match the length of the rigid connector. As before, the flying gooseneck may be supported by a crane or mounting apparatus (e.g., if using a tower or other substructure).

Aspects disclosed herein include:

A. A method for connecting coiled tubing strings, the method including: 1) lowering a downhole end of a first coiled tubing string within a wellbore, an uphole end of the first coiled tubing string remaining outside of the wellbore; 2) coupling the uphole end of the first coiled tubing string to a downhole end of a second coiled tubing string while the uphole end of the first coiled tubing string remains outside of the wellbore to form a combined coiled tubing string; and 3) lowering the combined coiled tubing string within the wellbore.

B. A coiled tubing working connector, the coiled tubing working connector including: 1) a coiled tubing connector insert configured to be positioned partially within an end of a coiled tubing string; and 2) a connector nut configured to couple an exposed end of the first coiled tubing connector insert and a coiled tubing fixture.

Aspects A and B may have one or more of the following additional elements in combination: Element 1: wherein the coupling occurs uphole of a coiled tubing injector while the first coiled tubing string remains within the coiled tubing injector. Element 2: wherein the coupling includes connecting a working connector between the uphole end of the first coiled tubing string and the downhole end of the second coiled tubing string to form the combined coiled tubing string. Element 3: wherein the working connector includes a first coiled tubing connector insert positioned partially within the uphole end of the first coiled tubing string, a second coiled tubing connector insert positioned partially within the downhole end of the second coiled tubing string, and a connector nut coupling an exposed end of the first coiled tubing connector insert and an exposed end of the second coiled tubing connector insert to form the combined coiled tubing string. Element 4: wherein the connector nut has a first set of connector nut threads coupled to a first set of connector insert threads of the first coiled tubing connector insert and a second set of connector nut threads coupled to a second set of connector insert threads of the second coiled tubing connector insert. Element 5: wherein the first set of connector nut threads and the second set of connector nut threads are opposite handedness, such that as the connector nut is spun in a direction about the first and second coiled tubing connector inserts the first and second coiled tubing connector inserts are brought toward one another to form the combined coiled tubing string. Element 6: wherein the first coiled tubing string has a first coiled tubing outside diameter ($D_{CTO1}$) and the second coiled tubing string has a second greater coiled tubing outside diameter ($D_{CTO2}$). Element 7: further wherein the working connector has a first working connector outside diameter ($D_{WCO1}$) proximate the first coiled tubing string and a second greater working connector outside diameter ($D_{WCO2}$) proximate the second coiled tubing string. Element 8: wherein an outside diameter transition of the working connector between the first working connector outside diameter ($D_{WCO1}$) and the second greater working connector outside diameter ($D_{WCO2}$) is a smooth outside diameter transition. Element 9: wherein the coupling the uphole end of the first coiled tubing string to the downhole end of the second coiled tubing string occurs without rigging down and rigging up the coiled tubing injector. Element 10: wherein the uphole end of the first coiled tubing string is coupled to a first coiled tubing connection on a first coiled tubing reel and the uphole end of the second coiled tubing string is coupled to a second coiled tubing connection on a second coiled tubing reel, and wherein coupling the uphole end of the first coiled tubing string to the downhole end of a second coiled tubing string further includes: 1) disconnecting the uphole end of the first coiled tubing string from the first coiled tubing connection on the first coiled tubing reel; 2) bringing a disconnected uphole end of the first coiled tubing string to a free end of the downhole end of a second coiled tubing string; and 3) installing a working connector to the disconnected uphole end of the first coiled tubing string and the free downhole end of the second coiled tubing string to form the combined coiled tubing string, and then lowering the combined coiled tubing string within the wellbore. Element 11: wherein bringing the disconnected uphole end of the first coiled tubing string to the free downhole end of a second coiled tubing string includes grabbing the disconnected uphole end of the first coiled tubing string and the free downhole end of the second coiled tubing string using telescopic/articulated pipe handling equipment and bringing the disconnected uphole end of the first coiled tubing string to the free downhole end of a second coiled tubing string using the telescopic/articulated pipe handling equipment, and installing a working connector to the disconnected uphole end of the first coiled tubing and the free downhole end of the second coiled tubing string to form the combined coiled tubing string includes installing a working connector to the disconnected uphole end of the first coiled tubing string and the free downhole end of the second coiled tubing string to form the combined coiled tubing string as the telescopic/articulated pipe handling equipment is in contact with the first and second coiled tubing strings. Element 12: further including: 1) withdrawing the combined coiled tubing string from the wellbore after lowering the combined coiled tubing string within the wellbore; 2) removing the working connector from the disconnected uphole end of the first coiled tubing string and the free downhole end of the second coiled tubing string to separate the first and second coiled tubing strings; 3) connecting the disconnected uphole end of the first coiled tubing string to the first coiled tubing connection on the first coiled tubing reel; then 4) withdrawing the first coiled tubing string from the wellbore. Element 13: wherein disconnecting the uphole end of the first coiled tubing string from the first coiled tubing connection on the first coiled tubing reel includes disconnecting a reel connector nut of the first coiled tubing reel from a connector insert positioned partially within the uphole end of the first coiled tubing string. Element 14: wherein the coiled tubing connector insert is a first coiled tubing connector insert configured to be positioned partially within an end of a first coiled tubing string, and further wherein the coiled tubing fixture is a second coiled tubing insert configured to be positioned partially within an end of a second coiled tubing string, and further wherein the connector nut is configured to engage an exposed end of the first coiled tubing connector insert and an exposed end of the second coiled tubing connector insert to form a combined coiled tubing string. Element 15: wherein the connector nut has a first set of connector nut threads coupleable to a first set of connector insert threads of the first coiled tubing connector insert and a second set of connector nut threads coupleable to a second set of connector insert threads of the second coiled tubing connector insert. Element 16: wherein the first set of connector nut threads and the second set of connector nut threads are opposite handedness, such that as the connector nut is spun in a direction about the first and second coiled tubing connector inserts the first and second coiled tubing connector inserts are brought toward one another to form the combined coiled tubing string. Element 17: wherein the working connector has a first working connector outside diameter ($D_{WCO1}$) proximate the first coiled tubing connector insert and a second greater working connector outside diameter ($D_{WCO2}$) proximate the second coiled tubing connector insert. Element 18: wherein an outside diameter transition of the working connector between the first working connector outside diameter ($D_{WCO1}$) and the second greater working connector outside diameter ($D_{WCO2}$) is a smooth outside diameter transition.

Those skilled in the art to which this application relates will appreciate that other and further additions, deletions, substitutions and modifications may be made to the described examples.

What is claimed is:

1. A method for connecting coiled tubing strings, comprising:

lowering a downhole end of a first coiled tubing string within a wellbore, an uphole end of the first coiled tubing string remaining outside of the wellbore;

coupling the uphole end of the first coiled tubing string to a downhole end of a second coiled tubing string while the uphole end of the first coiled tubing string remains outside of the wellbore to form a combined coiled tubing string, wherein the coupling occurs between a coiled tubing injector and a second coiled tubing reel that the second coiled tubing string at least partially resides upon while the first coiled tubing string remains within the coiled tubing injector; and lowering the combined coiled tubing string within the wellbore.

2. The method as recited in claim 1, wherein the coupling includes connecting a working connector between the uphole end of the first coiled tubing string and the downhole end of the second coiled tubing string to form the combined coiled tubing string.

3. The method as recited in claim 2, wherein the working connector includes a first coiled tubing connector insert positioned partially within the uphole end of the first coiled tubing string, a second coiled tubing connector insert positioned partially within the downhole end of the second coiled tubing string, and a connector nut coupling an exposed end of the first coiled tubing connector insert and an exposed end of the second coiled tubing connector insert to form the combined coiled tubing string.

4. The method as recited in claim 3, wherein the connector nut has a first set of connector nut threads coupled to a first set of connector insert threads of the first coiled tubing connector insert and a second set of connector nut threads coupled to a second set of connector insert threads of the second coiled tubing connector insert.

5. The method as recited in claim 4, wherein the first set of connector nut threads and the second set of connector nut threads are opposite handedness, such that as the connector nut is spun in a direction about the first and second coiled tubing connector inserts the first and second coiled tubing connector inserts are brought toward one another to form the combined coiled tubing string.

6. The method as recited in claim 2, wherein the first coiled tubing string has a first coiled tubing outside diameter ($D_{CTO1}$) and the second coiled tubing string has a second greater coiled tubing outside diameter ($D_{CTO2}$).

7. The method as recited in claim 6, further wherein the working connector has a first working connector outside diameter ($D_{WCO1}$) proximate the first coiled tubing string and a second greater working connector outside diameter ($D_{WCO2}$) proximate the second coiled tubing string.

8. The method as recited in claim 7, wherein an outside diameter transition of the working connector between the first working connector outside diameter ($D_{WCO1}$) and the second greater working connector outside diameter ($D_{WCO2}$) is a smooth outside diameter transition.

9. The method as recited in claim 1, wherein the coupling the uphole end of the first coiled tubing string to the downhole end of the second coiled tubing string occurs without rigging down and rigging up the coiled tubing injector.

10. The method as recited in claim 1, wherein the uphole end of the first coiled tubing string is coupled to a first coiled tubing connection on a first coiled tubing reel and the uphole end of the second coiled tubing string is coupled to a second coiled tubing connection on the second coiled tubing reel, and wherein coupling the uphole end of the first coiled tubing string to the downhole end of the second coiled tubing string further includes:

disconnecting the uphole end of the first coiled tubing string from the first coiled tubing connection on the first coiled tubing reel;

bringing a disconnected uphole end of the first coiled tubing string to a free end of the downhole end of a second coiled tubing string; and installing a working connector to the disconnected uphole end of the first coiled tubing string and the free downhole end of the second coiled tubing string to form the combined coiled tubing string, and then lowering the combined coiled tubing string within the wellbore.

11. The method as recited in claim 10, wherein bringing the disconnected uphole end of the first coiled tubing string to the free downhole end of the second coiled tubing string includes grabbing the disconnected uphole end of the first coiled tubing string and the free downhole end of the second coiled tubing string using telescopic/articulated pipe handling equipment and bringing the disconnected uphole end of the first coiled tubing string to the free downhole end of the second coiled tubing string using the telescopic/articulated pipe handling equipment, and installing the working connector to the disconnected uphole end of the first coiled tubing and the free downhole end of the second coiled tubing string to form the combined coiled tubing string includes installing the working connector to the disconnected uphole end of the first coiled tubing string and the free downhole end of the second coiled tubing string to form the combined coiled tubing string as the telescopic/articulated pipe handling equipment is in contact with the first and second coiled tubing strings.

12. The method as recited in claim 10, further including:

withdrawing the combined coiled tubing string from the wellbore after lowering the combined coiled tubing string within the wellbore;

removing the working connector from the disconnected uphole end of the first coiled tubing string and the free downhole end of the second coiled tubing string to separate the first and second coiled tubing strings;

connecting the disconnected uphole end of the first coiled tubing string to the first coiled tubing connection on the first coiled tubing reel; then withdrawing the first coiled tubing string from the wellbore.

13. The method as recited in claim 10, wherein disconnecting the uphole end of the first coiled tubing string from the first coiled tubing connection on the first coiled tubing reel includes disconnecting a reel connector nut of the first coiled tubing reel from a connector insert positioned partially within the uphole end of the first coiled tubing string.

14. The method as recited in claim 1, wherein the first coiled tubing string has a first coiled tubing outside diameter ($D_{CTO1}$) and the second coiled tubing string has a second greater coiled tubing outside diameter ($D_{CTO2}$).

15. A coiled tubing working connector, comprising:

a first coiled tubing connector insert configured to be positioned partially within an end of a first coiled tubing string;

a second coiled tubing insert configured to be positioned partially within an end of a second coiled tubing string; and a connector nut configured to engage an exposed end of the first coiled tubing connector insert and an exposed end of the second coiled tubing connector insert to form a combined coiled tubing string, wherein the connector nut has a first set of connector nut threads coupleable to a first set of connector insert threads of the first coiled tubing connector insert and a second set of connector nut threads coupleable to a second set of connector insert threads of the second coiled tubing connector insert, and further wherein the first set of connector nut threads and the second set of connector nut threads are opposite handedness, such that as the connector nut is spun in a direction about the first and second coiled tubing connector inserts the first and second coiled tubing connector inserts are brought toward one another to form the combined coiled tubing string.

16. The coiled tubing working connector as recited in claim 15, wherein the working connector has a first working connector outside diameter ($D_{WCO1}$) proximate the first coiled tubing connector insert and a second greater working connector outside diameter ($D_{WCO2}$) proximate the second coiled tubing connector insert.

17. The coiled tubing working connector as recited in claim 16, wherein an outside diameter transition of the working connector between the first working connector outside diameter ($D_{WCO1}$) and the second greater working connector outside diameter ($D_{WCO2}$) is a smooth outside diameter transition.

* * * * *